US011699394B2

(12) United States Patent
Yang

(10) Patent No.: US 11,699,394 B2
(45) **Date of Patent: *Jul. 11, 2023**

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventor: Chengchung Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/874,508

(22) Filed: Jul. 27, 2022

(65) Prior Publication Data

US 2022/0366851 A1 Nov. 17, 2022

Related U.S. Application Data

(63) Continuation of application No. 16/328,372, filed as application No. PCT/CN2018/093982 on Jul. 2, 2018, now Pat. No. 11,455,951.

(30) Foreign Application Priority Data

Aug. 25, 2017 (CN) ..... 201710749538.6

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2300/043; G09G 2320/045; G09G 2320/043; G09G 3/3258; G09G 2300/0819
See application file for complete search history.

(56) References Cited

U.S. PATENT DOCUMENTS 9,997,111 B2 6/2018 Yang et al.
10,203,553 B2 2/2019 Yang et al.
(Continued)

FOREIGN PATENT DOCUMENTS

CN 104022771 A * 12/2014
CN 104200771 A 12/2014
(Continued)

OTHER PUBLICATIONS

International Search Report of PCT/CN2018/093982 in Chinese, dated Sep. 26, 2018, with English translation.
(Continued)

*Primary Examiner* — Sanjiv D. Patel
(74) *Attorney, Agent, or Firm* — Collard & Roe, P.C.

(57) ABSTRACT

A pixel circuit, a driving method thereof and a display device are disclosed. The pixel circuit includes: a reset sub-circuit, a drive sub-circuit, a write sub-circuit, a compensation sub-circuit, a light-emitting control sub-circuit and a light-emitting element. The drive transistor is in the on-bias state in the reset period; the write sub-circuit is configured to write a data voltage of the data voltage terminal into the drive sub-circuit; the compensation sub-circuit is configured to compensate a threshold voltage of the drive transistor in the drive sub-circuit; the light-emitting control sub-circuit is configured to transmit a drive current, generated by the drive sub-circuit under action of the first voltage terminal, the second voltage terminal and the data voltage written into the drive sub-circuit, to the light-emitting element; and the light-emitting element is configured to emit light according to the drive current.

12 Claims, 25 Drawing Sheets

(52) U.S. Cl.
CPC ..... *G09G 2300/0842* (2013.01); *G09G 2320/0257* (2013.01)

(56) References Cited

U.S. PATENT DOCUMENTS

| | | | | |
|---|---|---|---|---|
| 2010/0164847 | A1 | 7/2010 | Lee et al. | |
| 2014/0313241 | A1* | 10/2014 | Ono | G09G 3/3659 345/76 |
| 2015/0103037 | A1 | 4/2015 | Wu et al. | |
| 2015/0294618 | A1* | 10/2015 | Park | G09G 3/3291 345/78 |
| 2016/0019842 | A1* | 1/2016 | Kim | G09G 3/3291 345/694 |
| 2017/0031485 | A1 | 2/2017 | Kim et al. | |
| 2018/0330663 | A1 | 11/2018 | Yang et al. | |

FOREIGN PATENT DOCUMENTS

| | | | |
|---|---|---|---|
| CN | 105096833 | A | 11/2015 |
| CN | 105137656 | A | 12/2015 |
| CN | 106489175 | A | 3/2017 |
| CN | 107358918 | A | 11/2017 |
| CN | 207082320 | U | 3/2018 |

OTHER PUBLICATIONS

Notice of Transmittal of the International Search Report of PCT/CN2018/093982 in Chinese, dated Sep. 26, 2018.

Written Opinion of the International Searching Authority of PCT/CN2018/093982 in Chinese, dated Sep. 26, 2018 with English translation.

Non-Final Office Action in U.S. Appl. No. 16/328,372 dated Nov. 1, 2021.

Final Office Action in U.S. Appl. No. 16/328,372 dated Feb. 14, 2022.

Notice of Allowance in U.S. Appl. No. 16/328,372 dated May 18, 2022.

Advisory Action in U.S. Appl. No. 16/328,372 dated Apr. 20, 2022.

* cited by examiner

PIXEL CIRCUIT, DRIVING METHOD THEREOF AND DISPLAY DEVICE

CROSS REFERENCE

This application is a continuation of U.S. patent application Ser. No. 16/328,372 filed on Feb. 26, 2019, which is the National Stage of PCT/CN2018/093982 filed on Jul. 2, 2018, which claims priority under 35 U.S.C. 119 of Chinese Application No. 201710749538.6 filed on Aug. 25, 2017, the disclosure of which is incorporated by reference.

TECHNICAL FIELD

The present disclosure relates to the technical field of display, in particular to a pixel circuit, a driving method thereof and a display device.

BACKGROUND

Organic light-emitting diode (OLED) display is one of the hot spots in the research field at present. Compared with liquid crystal displays (LCDs), OLED displays have the advantages of low energy consumption, low production cost, autoluminescence, wide viewing angle, rapid response speed, etc.

However, when an OLED display switches between different grayscale images, for example, switching from a checkerboard image as illustrated in FIG. 1*a* to a pure grayscale image with the grayscale value of 128, the short-term afterimage phenomenon occurs, and the image displayed at this time is shown in FIG. 1*b*. There is an afterimage of the previous frame of checkerboard image on the display image. The above short-term afterimage phenomenon disappears after one minute. In this case, the pure grayscale image with the grayscale value of 128, displayed by the display, is as illustrated in FIG. 1*c*. The above short-term afterimage phenomenon affects the display effect.

SUMMARY

Embodiments of the present disclosure provide a pixel circuit, a driving method thereof and a display device.

An aspect of the embodiments of the present disclosure provides a pixel circuit, comprising: a reset sub-circuit, a drive sub-circuit, a write sub-circuit, a compensation sub-circuit, a light-emitting control sub-circuit and a light-emitting element, wherein the drive sub-circuit comprises a drive transistor; a first electrode of the drive transistor is connected with the write sub-circuit; the reset sub-circuit is configured to be connected with an initial voltage terminal, a third voltage terminal and the drive sub-circuit and is configured to write an initial voltage of the initial voltage terminal into a gate electrode of the drive transistor in the drive sub-circuit and write a voltage of the third voltage terminal into a first electrode or a second electrode of the drive transistor; the drive transistor is in the on-bias state in the reset period; the write sub-circuit is configured to be connected with a data voltage terminal and the drive sub-circuit and is configured to write a data voltage of the data voltage terminal into the drive sub-circuit; the compensation sub-circuit is connected with the drive sub-circuit and is configured to compensate a threshold voltage of the drive transistor in the drive sub-circuit; the light-emitting control sub-circuit is configured to be connected with a luminescent control signal terminal, a first voltage terminal, the drive sub-circuit and an anode of the light-emitting element; a cathode of the light-emitting element is connected with a second voltage terminal; the light-emitting control sub-circuit is configured to transmit a drive current, generated by the drive sub-circuit under action of the first voltage terminal, the second voltage terminal and the data voltage written into the drive sub-circuit, to the light-emitting element; and the light-emitting element is configured to emit light according to the drive current.

Optionally, the reset sub-circuit is further connected with the anode of the light-emitting element and is configured to write the initial voltage of the initial voltage terminal into the anode of the light-emitting element.

Optionally, the write sub-circuit comprises a first transistor; a gate electrode of the first transistor is configured to be connected with a first gate signal terminal; a first electrode of the first transistor is configured to be connected with the data voltage terminal; a second electrode of the first transistor is connected with the first electrode of the drive transistor; the compensation sub-circuit comprises a second transistor; a gate electrode of the second transistor is configured to be connected with a second gate signal terminal; a first electrode of the second transistor is connected with the gate electrode of the drive transistor; a second electrode of the second transistor is connected with the second electrode of the drive transistor; the light-emitting control sub-circuit comprises a third transistor and a fourth transistor; a gate electrode of the third transistor is configured to be connected with a third gate signal terminal; a first electrode of the third transistor is configured to be connected with the first voltage terminal; a second electrode of the third transistor is connected with the first electrode of the drive transistor; a gate electrode of the fourth transistor is configured to be connected with a fourth gate signal terminal; a first electrode of the fourth transistor is connected with the second electrode of the drive transistor; a second electrode of the fourth transistor is connected with the anode of the light-emitting element; the drive sub-circuit further comprises a storage capacitor; and one end of the storage capacitor is configured to be connected with the first voltage terminal, and another end of the storage capacitor is connected with the gate electrode of the drive transistor.

Optionally, the reset sub-circuit comprises a gate electrode reset sub-sub-circuit and a first electrode reset sub-sub-circuit; the gate electrode reset sub-sub-circuit is configured to be connected with the initial voltage terminal and the gate electrode of the drive transistor and is configured to write the initial voltage of the initial voltage terminal into the gate electrode of the drive transistor; the first electrode reset sub-sub-circuit is configured to be connected with the third voltage terminal and the first electrode of the drive transistor and is configured to write the voltage of the third voltage terminal into the first electrode of the drive transistor; or the reset sub-circuit comprises a gate electrode reset sub-sub-circuit and a second electrode reset sub-sub-circuit; the gate electrode reset sub-sub-circuit is configured to be connected with the third voltage terminal and the second electrode of the drive transistor; and the second electrode reset sub-sub-circuit is configured to write the voltage of the third voltage terminal into the second electrode of the drive transistor.

Optionally, the gate electrode reset sub-sub-circuit comprises a fifth transistor; a gate electrode of the fifth transistor is configured to be connected with a fifth gate signal terminal; a first electrode of the fifth transistor is connected with the gate electrode of the drive transistor; and a second electrode of the fifth transistor is configured to be connected with the initial voltage terminal.

Optionally, in a case where the reset sub-circuit is further connected with the anode of the light-emitting element, the gate electrode reset sub-sub-circuit comprises a sixth transistor; a gate electrode of the sixth transistor is configured to be connected with a six gate signal terminal; a first electrode of the sixth transistor is connected with the anode of the light-emitting element; a second electrode of the sixth transistor is configured to be connected with the initial voltage terminal; the compensation sub-circuit is reused as a part of the gate electrode reset sub-sub-circuit, and the gate electrode reset sub-sub-circuit further comprises the second transistor; and a part of the light-emitting control sub-circuit is reused as a part of the gate electrode reset sub-sub-circuit, and the gate electrode reset sub-sub-circuit further comprises the fourth transistor.

Optionally, the third voltage terminal is configured to be connected with the data voltage terminal; in a case where the reset sub-circuit comprises the first electrode reset sub-sub-circuit, the write sub-circuit is reused as the first electrode reset sub-sub-circuit; and the first electrode reset sub-sub-circuit comprises the first transistor.

Optionally, the third voltage terminal is configured to be connected with the first voltage terminal; in a case where the reset sub-circuit comprises the first electrode reset sub-sub-circuit, a part of the light-emitting control sub-circuit is reused as the first electrode reset sub-sub-circuit; and the first electrode reset sub-sub-circuit comprises the third transistor.

Optionally, the third voltage terminal is configured to be connected with a reference voltage terminal; in a case where the reset sub-circuit comprises the second electrode reset sub-sub-circuit, the second electrode reset sub-sub-circuit comprises a seventh transistor; a gate electrode of the seventh transistor is configured to be connected with a seventh control signal terminal; a first electrode of the seventh transistor is configured to be connected with the reference voltage terminal; and a second electrode of the seventh transistor is connected with the second electrode of the drive transistor.

Optionally, the third voltage terminal is configured to be connected with a reference voltage terminal; in a case where the reset sub-circuit comprises the first electrode reset sub-sub-circuit, the first electrode reset sub-sub-circuit comprises a seventh transistor; a gate electrode of the seventh transistor is configured to be connected with a seventh control signal terminal; a first electrode of the seventh transistor is configured to be connected with the reference voltage terminal; and a second electrode of the seventh transistor is connected with the first electrode of the drive transistor.

Optionally, in a case where the reset sub-circuit is further connected with the anode of the light-emitting element, the reset sub-circuit further comprises a sixth transistor; a gate electrode of the sixth transistor is configured to be connected with a sixth gate signal terminal; a first electrode of the sixth transistor is connected with the anode of the light-emitting element; and a second electrode of the sixth transistor is configured to be connected with the initial voltage terminal.

Another aspect of the embodiments of the present disclosure provides a display device, comprising the pixel circuit according to any one of the above pixel circuits.

The embodiments of the present disclosure provides a method for driving the pixel circuit according to any one of the above pixel circuits, wherein within one image frame, the method comprises: in the reset period, the reset sub-circuit operates to write the initial voltage of the initial voltage terminal into the gate electrode of the drive transistor in the drive sub-circuit and write the voltage of the third voltage terminal into the first electrode or the second electrode of the drive transistor; the drive transistor is in the on-bias state in the reset period; in the write compensation period, the write sub-circuit operates to write the data voltage of the data voltage terminal into the drive sub-circuit; the compensation sub-circuit operates to compensate the threshold voltage of the drive transistor in the drive sub-circuit; in the light emission period, the drive sub-circuit operates to generate the drive current under action of the first voltage terminal, the second voltage terminal and the data voltage written into the drive sub-circuit; the light-emitting control sub-circuit operates to transmit the drive current to the light-emitting element under the control of the luminescent control signal terminal; and the light-emitting element operates to emit light according to the drive current.

Optionally, in a case where the write sub-circuit comprises the first transistor, the compensation sub-circuit comprises the second transistor, the light-emitting control sub-circuit comprises the third transistor and the fourth transistor, the reset sub-circuit comprises the gate electrode reset sub-sub-circuit and the first electrode reset sub-sub-circuit, the gate electrode reset sub-sub-circuit comprises the fifth transistor, and the first electrode reset sub-sub-circuit comprises the first transistor, the method comprises: the first gate signal terminal connected with the gate electrode of the first transistor, the third gate signal terminal connected with the gate electrode of the third transistor, and the fourth gate signal terminal connected with the gate electrode the fourth transistor all receiving signals outputted by the luminescent control signal terminal; the second gate signal terminal connected with the gate electrode of the second transistor receiving signals outputted by a first scanning signal terminal; and the fifth gate signal terminal connected with the gate electrode of the fifth transistor receiving signals outputted by a second scanning signal terminal.

Optionally, in a case where the write sub-circuit comprises the first transistor, the compensation sub-circuit comprises the second transistor, the light-emitting control sub-circuit comprises the third transistor and the fourth transistor, the reset sub-circuit comprises the gate electrode reset sub-sub-circuit and the first electrode reset sub-sub-circuit, the gate electrode reset sub-sub-circuit comprises the fifth transistor, and the first electrode reset sub-sub-circuit comprises the third transistor, the method comprises: the first gate signal terminal connected with the gate electrode of the first transistor, the third gate signal terminal connected with the gate electrode of the third transistor, and the second gate signal terminal connected with the gate electrode of the second transistor all receiving signals outputted by a first scanning signal terminal; the fourth gate signal terminal connected with the gate electrode the fourth transistor receiving signals outputted by the luminescent control signal terminal; and the fifth gate signal terminal connected with the gate electrode of the fifth transistor receiving signals outputted by a second scanning signal terminal.

Optionally, in a case where the write sub-circuit comprises the first transistor, the compensation sub-circuit comprises the second transistor, the light-emitting control sub-circuit comprises the third transistor and the fourth transistor, the reset sub-circuit comprises the gate electrode reset sub-sub-circuit and the second electrode reset sub-sub-circuit, the gate electrode reset sub-sub-circuit comprises the fifth transistor, and the second electrode reset sub-sub-circuit comprises the seventh transistor, the method comprises: both the first gate signal terminal connected with the gate electrode of the first transistor and the second gate signal terminal connected with the gate electrode of the second transistor receiving signals outputted by a first scanning signal terminal; both the third gate signal terminal connected with the gate electrode of the third transistor and the fourth gate signal terminal connected with the gate electrode the fourth transistor receiving signals outputted by the luminescent control signal terminal; and both the fifth gate signal terminal connected with the gate electrode of the fifth transistor and the seventh gate signal terminal connected with the gate electrode of the seventh transistor receiving signals outputted by a second scanning signal terminal.

Optionally, in a case where the write sub-circuit comprises the first transistor, the compensation sub-circuit comprises the second transistor, the light-emitting control sub-circuit comprises the third transistor and the fourth transistor, the reset sub-circuit comprises the gate electrode reset sub-sub-circuit and the first electrode reset sub-sub-circuit, the gate electrode reset sub-sub-circuit comprises the second transistor, the fourth transistor and the sixth transistor, and the first electrode reset sub-sub-circuit comprises the first transistor, the method comprises: the first gate signal terminal connected with the gate electrode of the first transistor, the second gate signal terminal connected with the gate electrode of the second transistor, and the third gate signal terminal connected with the gate electrode of the third transistor all receiving signals outputted by the luminescent control signal terminal; the fourth gate signal terminal connected with the gate electrode the fourth transistor receiving signals outputted by a first scanning signal terminal; and the sixth gate signal terminal connected with the sixth transistor receiving signals outputted by a second scanning signal terminal.

Optionally, in a case where the write sub-circuit comprises the first transistor, the compensation sub-circuit comprises the second transistor, the light-emitting control sub-circuit comprises the third transistor and the fourth transistor, the reset sub-circuit comprises the gate electrode reset sub-sub-circuit and the first electrode reset sub-sub-circuit, the gate electrode reset sub-sub-circuit comprises the second transistor, the fourth transistor and the sixth transistor, and the first electrode reset sub-sub-circuit comprises the seventh transistor, the method comprises: both the first gate signal terminal connected with the gate electrode of the first transistor and the fourth gate signal terminal connected with the gate electrode the fourth transistor receiving signals outputted by a first scanning signal terminal; both the second gate signal terminal connected with the gate electrode of the second transistor and the third gate signal terminal connected with the gate electrode of the third transistor receiving signals outputted by the luminescent control signal terminal; and both the sixth gate signal terminal connected with the sixth transistor and the seventh gate signal terminal connected with the seventh transistor receiving signals outputted by a second scanning signal terminal.

Optionally, the reset sub-circuit comprises the sixth transistor; and the method comprises: the sixth gate signal terminal connected with the sixth transistor receiving signals outputted by the first scanning signal terminal or the second scanning signal terminal.

Embodiments of the present disclosure provide a pixel circuit, a driving method thereof and a display device. As known from the above, the reset module in the pixel circuit can allow the DTFT to be in the on-bias state after the end of the reset period. In this case, when the DTFT is in the on-bias state in the reset period in a pixel circuit of each sub-pixel of a display panel, the gate-source voltage Vgs of DTFTs of different sub-pixels is located at the top of the characteristic curve. The corresponding current Ids is the same, and the current Ids is large. Thus, when the next image frame is displayed, the brightness of each sub-pixel must be reduced, namely the current Ids of the DTFT in each sub-pixel must be reduced. Therefore, an interface between the semiconductor layer and the gate insulator of the DTFT in each sub-pixel must be subjected to hole detrapping. Moreover, the hole detrapping path of each DTFT is same, so the above short-term afterimage problem can be solved.

BRIEF DESCRIPTION OF THE DRAWINGS

In order to more clearly illustrate the embodiments of the present disclosure or the technical proposals know to the inventor, simple description will be given below to the accompanying drawings required to be used in the description of the embodiments or the technical proposals known to the inventor. Obviously, the drawings described below only involve some embodiments of the present disclosure. Other accompanying drawings may also be obtained by those skilled in the art without creative efforts on the basis of the accompanying drawings.

REFERENCE NUMERALS OF THE ACCOMPANYING DRAWINGS

10—reset module; 20—drive module; 30—write module; 40—compensation module; 50—luminescent control module; S1—first scanning signal terminal; S2—second scanning signal terminal; EM—luminescent control signal terminal; Vint—initial voltage terminal; Data—data voltage terminal; ELVDD—first voltage terminal; ELVSS—second voltage terminal; G1—first gate signal terminal; G2—second gate signal terminal; G3—third gate signal terminal; G4—fourth gate signal terminal; G5—fifth gate signal terminal; G6—sixth gate signal terminal; G7—seventh gate signal terminal; P1—reset period; P2—write compensation period; P3—light emission period.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Figure 2:
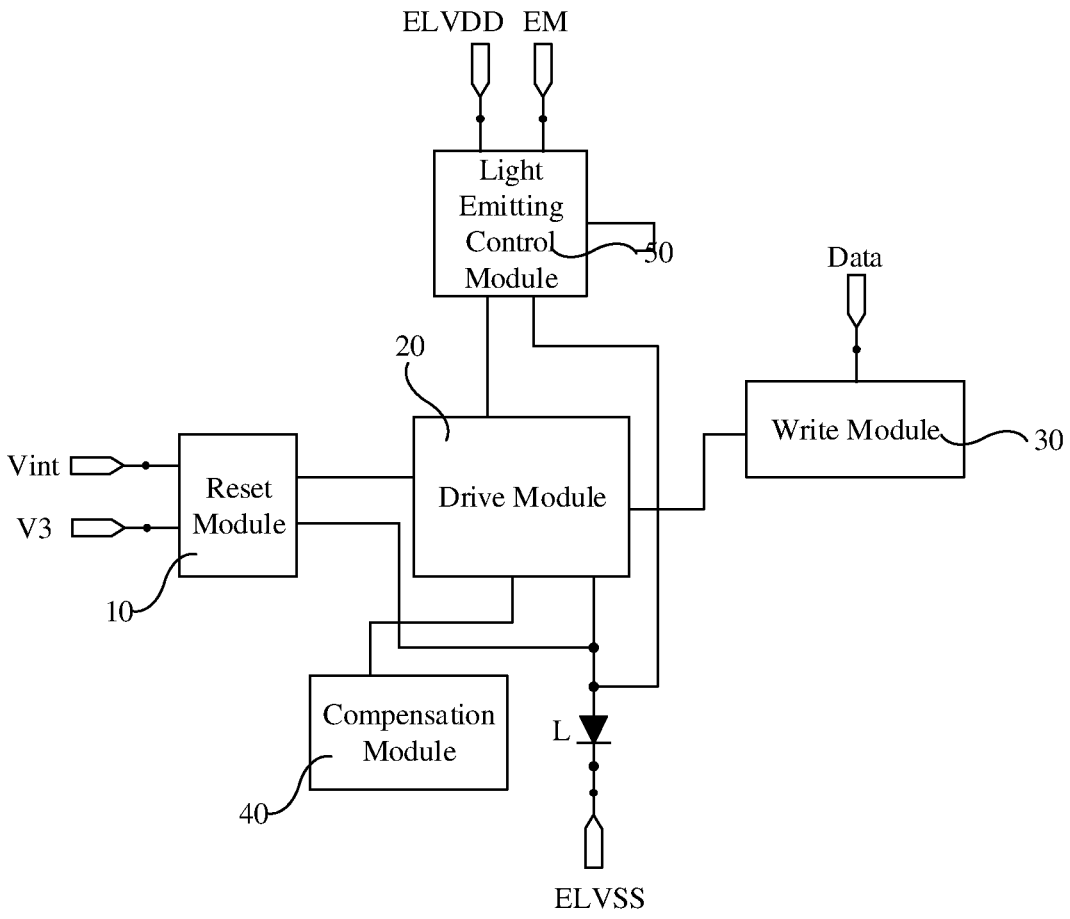
FIG. 2 is a schematic structural view of a pixel circuit provided by an embodiment of the present disclosure.

The embodiments of the present disclosure provide a pixel circuit, which, as illustrated in FIG. 2, comprises a reset module 10, a drive module 20, a write module 30, a compensation module 40, a luminescent control module 50 and a light-emitting element L.

The drive module 20, as illustrated in FIG. 3, includes a drive transistor (hereafter referred to as DTFT); and a first electrode of the DTFT is connected with the write module 30.

Moreover, the drive module 20 is also connected with a first voltage terminal ELVDD. At this point, the drive module 20 further includes a storage capacitor Cst. One end of the storage capacitor Cst is connected with the first voltage terminal ELVDD, and the other end is connected with a gate electrode of the DTFT. In this way, the storage capacitor Cst can ensure the stability of the gate voltage Vg of the DTFT.

Description will be given below to the connecting mode of the above modules.

Specifically, as illustrated in FIG. 2, the reset module 10 is connected with an initial voltage terminal Vint, a third voltage terminal V3, and the drive module 20. The reset module 10 is configured to write the initial voltage of the initial voltage terminal Vint into the gate electrode of the DTFT in the drive module 20 and write the voltage of the third voltage terminal V3 into a first electrode of the DTFT. The DTFT is in the on-bias state in the reset period.

It should be noted that the type of the DTFT is not limited in the present application, and the DTFT may be an N-type transistor and may also be a P-type transistor. Description will be given below by taking the case in which the DTFT is a P-type enhancement transistor as an example. In this case, the first electrode of the DTFT is a source electrode and the second electrode second electrode is a drain electrode.

On the basis of the above, when the initial voltage of the initial voltage terminal Vint is written into the gate electrode of the DTFT, as the initial voltage terminal Vint is usually at a low level, at this point, the DTFT is switched on. The voltage of the third voltage terminal V3 is written into the first pole, namely the source electrode, of the DTFT. At this point, the gate-source voltage of the DTFT is Vgs=Vint−V3. In this case, the output voltage of the third voltage terminal V3 can be controlled, so that Vgs=Vint−V3<Vth, and then the DTFT can be in the on-bias state. As for a P-type enhancement transistor, the switching condition is Vgs<Vth, and Vth is a negative value.

Analysis shows that the above short-term afterimage phenomenon is relevant to the hysteresis effect of the drive thin-film transistors (DTFTs) in the OLED display. The process of the hysteresis effect is as illustrated in FIG. 1*d*, in which the dot and dash line in FIG. 1*d* is a characteristic curve of the current Ids and the voltage Vgs of the DTFT when the source-drain voltage of DTFTs in sub-pixels for displaying a white image in the OLED display is Vds1; the dotted line is a characteristic curve of the current Ids and the voltage Vgs of the DTFT when the source-drain voltage of DTFTs in sub-pixels for displaying a black image is Vds3; and the solid line is a characteristic curve of the current Ids and the voltage Vgs of the DTFT when the source-drain voltage of DTFTs in sub-pixels for displaying an image with the grayscale of 128 is Vds2.

Figure 1A:
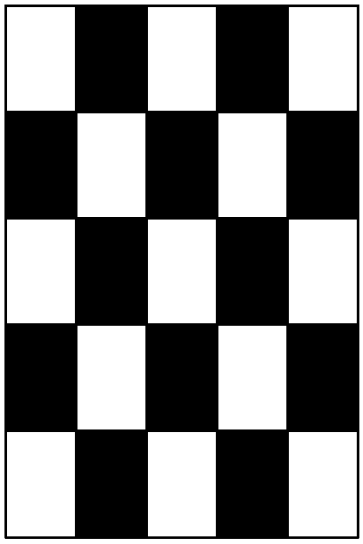
FIG. 1*a* illustrates a display image provided by the technical proposal known to the inventor.
Figure 1B:
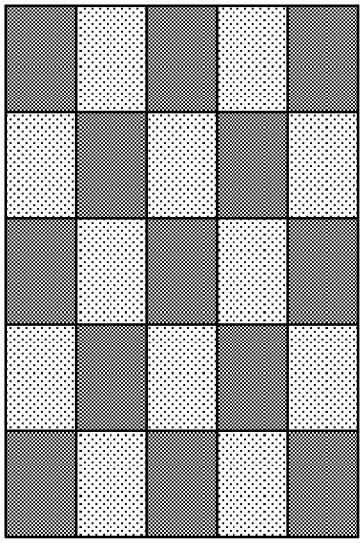
FIG. 1*b* is a schematic diagram illustrating the case in which there is a short-term afterimage on an image displayed by the technical proposal known to the inventor.
Figure 1C:
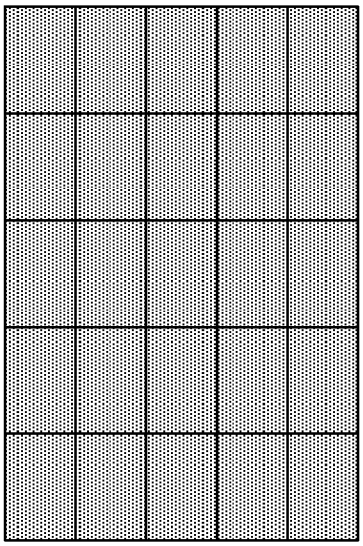
FIG. 1*c* illustrates another display image provided by the technical proposal known to the inventor.

As can be seen from FIG. 1*b*, when the white image is switched to the grayscale image, the brightness of the sub-pixels for displaying the white image must be reduced, and the current Ids of the DTFTs in the sub-pixels must be reduced, so an interface between a semiconductor layer and a gate insulator of the DTFT in the sub-pixel must be subjected to hole detrapping, and at this point, the Vgs value is converted from V_w into V_g from a point A1 to a point A2; and when the black image is switched to the grayscale image, the brightness of the sub-pixels for displaying the black image must be increased, and the current Ids of the DTFTs in the sub-pixels must be increased, so an interface between the semiconductor layer and the gate insulator of the DTFT in the sub-pixel must be subjected to hole trapping, and at this point, the Vgs value is converted from V_b into V_g from a point A3 to a point A4. It can be seen from this that as the voltage change paths during hole trapping and detrapping are different, the currents Ids corresponding to the points A2 and A4 which reach the voltage V-g along different paths are different. In this way, there is brightness difference between the sub-pixels switching from the white image to the grayscale image and the sub-pixels switching from the black image to the grayscale image, so the short-term afterimage phenomenon as illustrated in FIG. 1*c* can occur. After being placed for a period of time, both the point A2 and the point A4 reach a point B, and the afterimage disappears.

Figure 1D:
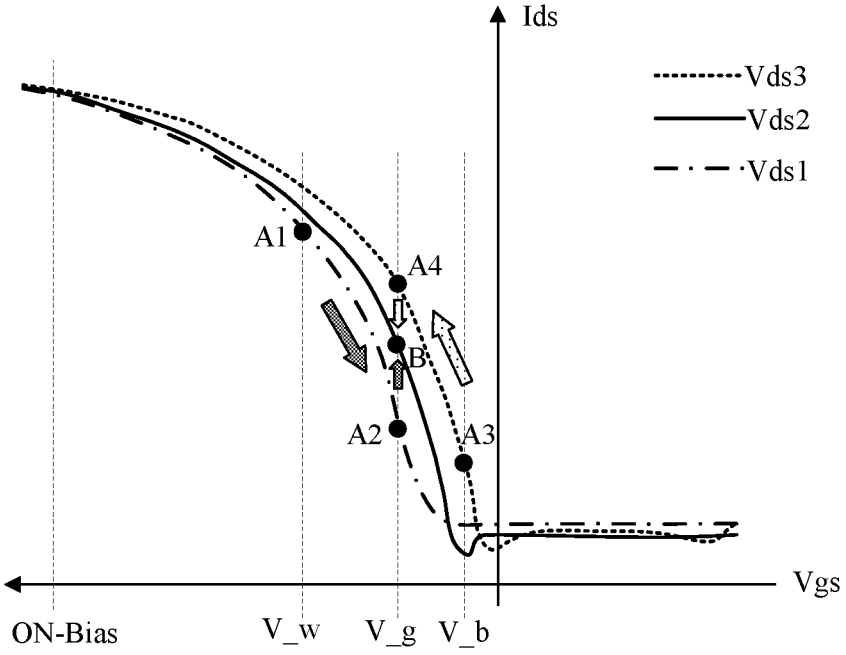
FIG. 1*d* is a diagram illustrating the principle of producing the short-term afterimage in the technical proposal known to the inventor.

On the basis of the above, when the DTFT is in the on-bias state in the reset period in the pixel circuit of each sub-pixel of the display panel, as illustrated in FIG. 1*d*, the gate-source voltages Vgs of the DTFTs of different sub-pixels are located at the top of the characteristic curve; the corresponding currents Ids are the same; and the currents Ids are large. Thus, in the process of displaying the next image frame, the brightness of each sub-pixel must be reduced, namely the current Ids of the DTFT in each sub-pixel must be reduced, so the interface between the semiconductor layer and the gate insulator of the DTFT in each sub-pixel must be subjected to hole detrapping, from the point A1 and the point A2, and the hole detrapping paths of the DTFTs are the same. Thus, the above short-term afterimage problem can be solved. In addition, as the pixel circuit provided by the application can solve the short-term afterimage problem, considering that the display panel needs a certain display refresh rate when displaying the image, there is no need to hold still the display image.

On the basis of the above, as illustrated in FIG. 2, the reset module 10 is also connected with an anode of the light-emitting element L. The reset module 10 is configured to write the initial voltage of the initial voltage terminal Vint into the anode of the light-emitting element L. In this way, the voltage of the previous image frame remaining in the anode of the light-emitting element L will not affect the image displayed by the next image frame. For instance, if the anode of the light-emitting element L is not reset by the reset module 10, when the image is displayed by the next image frame, the voltage remaining on the anode of the light-emitting element L will result in the increase of the drive current $I_{OLED}$ flowing across the light-emitting element L, causing the brightness of the sub-pixel to be greater than the expected brightness, thereby reducing the contrast of the display image.

A cathode of the light-emitting element L is connected with a second voltage terminal ELVSS. The light-emitting element L may be an LED or an OLED. No limitation will be given here in the present disclosure.

In addition, the write module 30 is connected with a data voltage terminal Data and the drive module 20. The write module 30 is configured to write the data voltage Vdata of the data voltage terminal Data into the drive module 20, so the drive current $I_{OLED}$ generated by the drive module 20 and configured to drive the light-emitting element L to emit light can be matched with the data voltage Vdata.

The compensation module 40 is connected with the drive module 20. The compensation module 40 is configured to compensate the threshold voltage Vth of the DTFT in the drive module.

The luminescent control module 50 is connected with the luminescent control signal terminal EM, the first voltage terminal ELVDD, the drive module 20, and the anode of the light-emitting element L. The luminescent control module is configured to transmit the drive current $I_{OLED}$, generated by the drive module 20 under action of the first voltage terminal ELVDD, the second voltage terminal ELVSS and the data voltage Vdata written into the drive module 20, to the light-emitting element L. The light-emitting element L is configured to emit light according to the drive current $I_{OLED}$.

In summary, regardless of the data voltages of the previous image frame, the DTFTs in the sub-pixels are subjected to data voltage write and threshold voltage compensation in the same state, namely the ON-Bias state, so the short-term afterimage problem, produced by the hysteresis effect, can be avoided.

It should be noted that in the embodiments of the present disclosure, the first voltage terminal ELVDD is configured to output a constant high level. The second voltage terminal ELVSS is configured to output a constant low level. For instance, the second voltage terminal ELVSS may be connected to a ground terminal. Moreover, the terms "high" and "low" in this description only indicate the relative magnitude relationship of the input voltage.

Figure 3A:
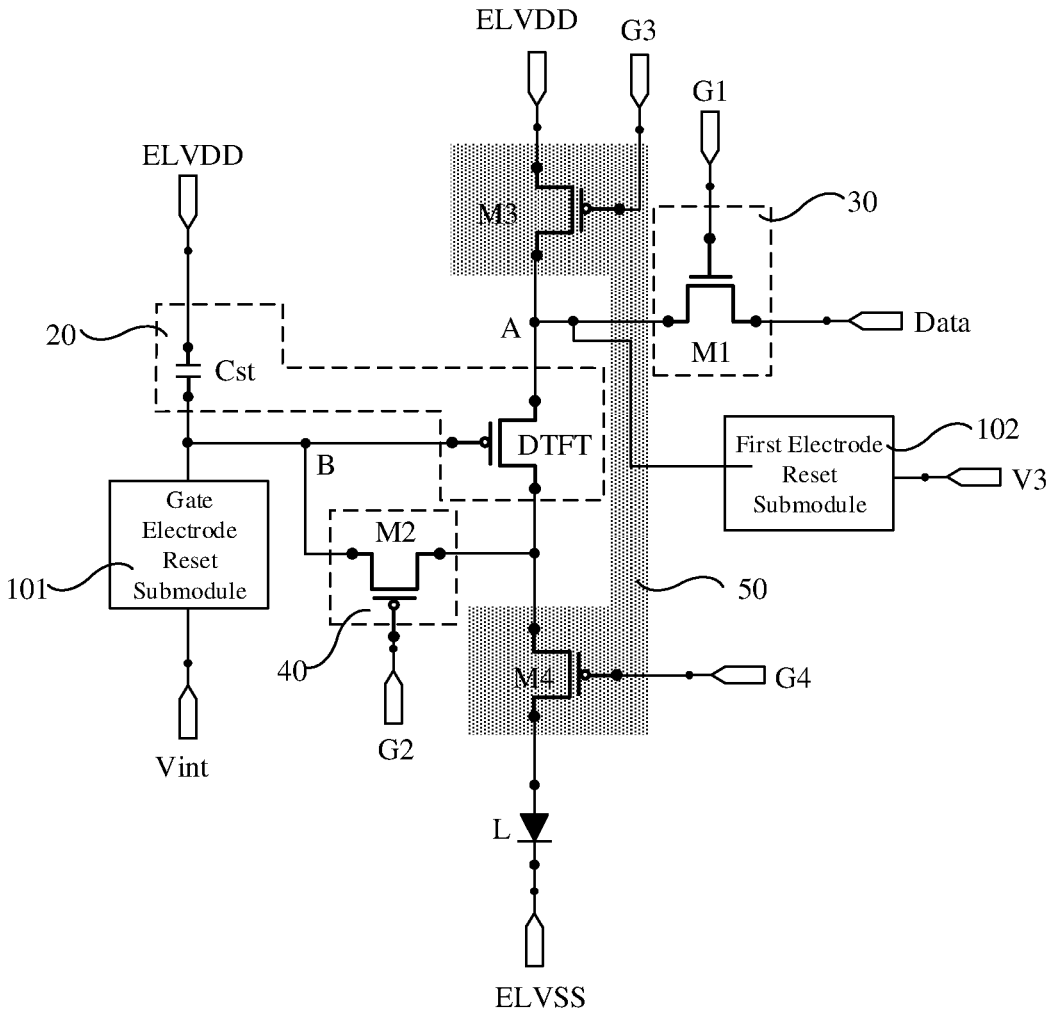
FIG. 3*a* is a specific schematic structural view of some modules in FIG. 2.
Figure 3B:
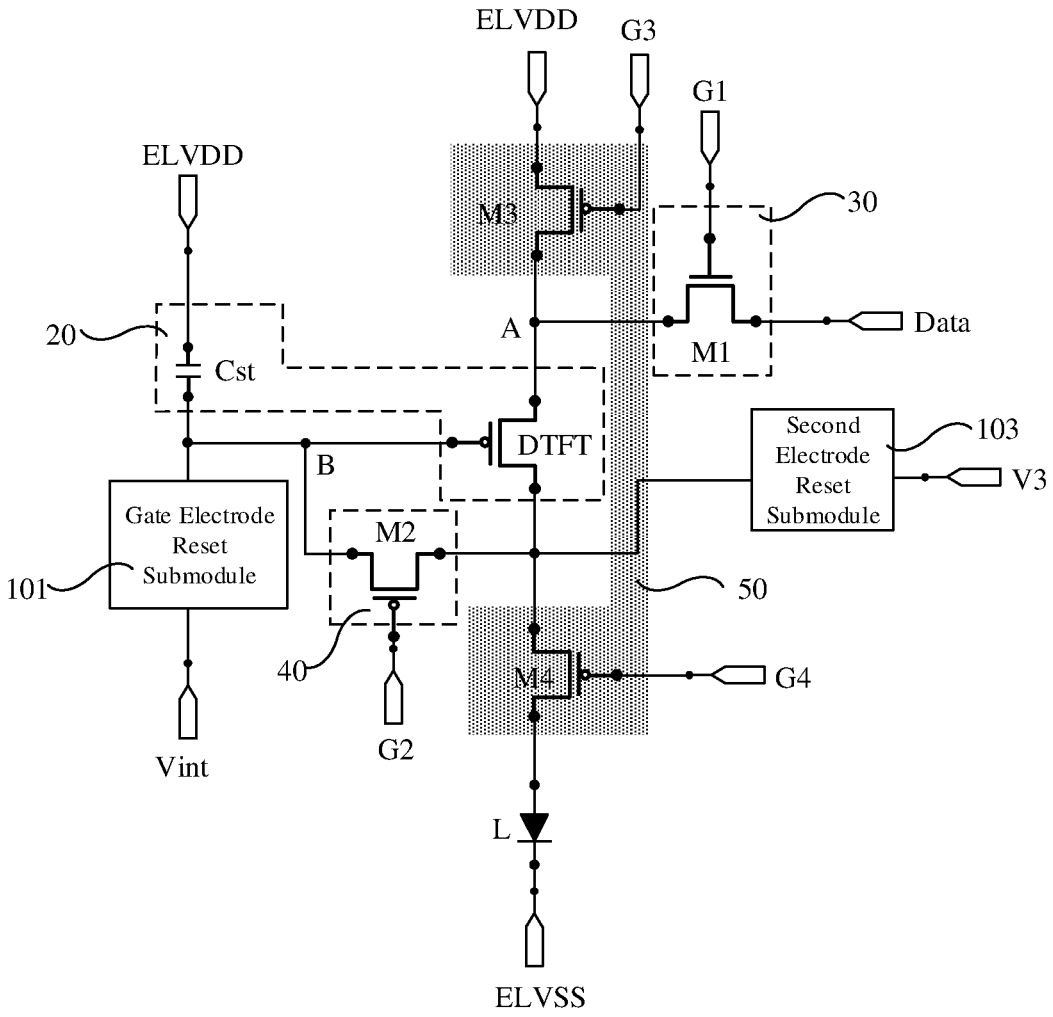
FIG. 3*b* is another specific schematic structural view of some modules in FIG. 2.

On the basis of the above, as illustrated in FIG. 3*a* or 3*b*, the write module 30 includes a first transistor M1; a gate electrode of the first transistor M1 is connected with a first gate signal terminal G1; a first electrode is connected with the data voltage terminal Data; and a second electrode is connected with the first electrode of the DTFT.

The compensation module 40 includes a second transistor M2. A gate electrode of the second transistor M2 is connected with a second gate signal terminal G2; a first electrode is connected with the gate electrode of the DTFT; and a second electrode is connected with the second electrode of the DTFT.

The luminescent control module 50 includes a third transistor M3 and a fourth transistor M4. A gate electrode of the third transistor M3 is connected with a third gate signal terminal G3; a first electrode is connected with the first voltage terminal ELVDD; and a second electrode is connected with the first electrode of the DTFT.

A gate electrode of the fourth transistor M4 is connected with a fourth gate signal terminal G4; a first electrode is connected with the second electrode of the DTFT; and a second electrode is connected with the anode of the light-emitting element L.

On the basis of the above, the reset module 10 includes a gate electrode reset sub-module 101 and a first electrode reset sub-module 102 as illustrated in FIG. 3*a*.

The gate electrode reset sub-module 101 is connected with the initial voltage terminal Vint and the gate electrode of the DTFT. The gate electrode reset sub-module 101 is configured to write the initial voltage of the initial voltage terminal Vint into the gate electrode of the DTFT.

The first electrode reset sub-module 102 is connected with the third voltage terminal V3 and the first electrode of the DTFT. The first electrode reset sub-module 102 is configured to write the voltage of the third voltage terminal V3 into the first electrode of the DTFT.

Or, the reset module 10 includes a gate electrode reset sub-module 101 and a second electrode reset sub-module 103 as illustrated in FIG. 3*b*. The connecting mode and the function of the gate electrode reset sub-module 101 are as described above.

In addition, the second electrode reset sub-module 103 is connected with the third voltage terminal V3 and the second electrode of the DTFT. The second electrode reset sub-module 103 is configured to write the voltage of the third voltage terminal V3 into the second electrode of the DTFT.

Based on the above structure, the obtained pixel circuits having different structures are exemplified below according to different setting modes of the reset module 10.

First Embodiment

In the embodiment, the setting modes of the write module 30, the compensation module 40 and the luminescent control module 50 are as described above, so no further description will be given here.

Figure 4:
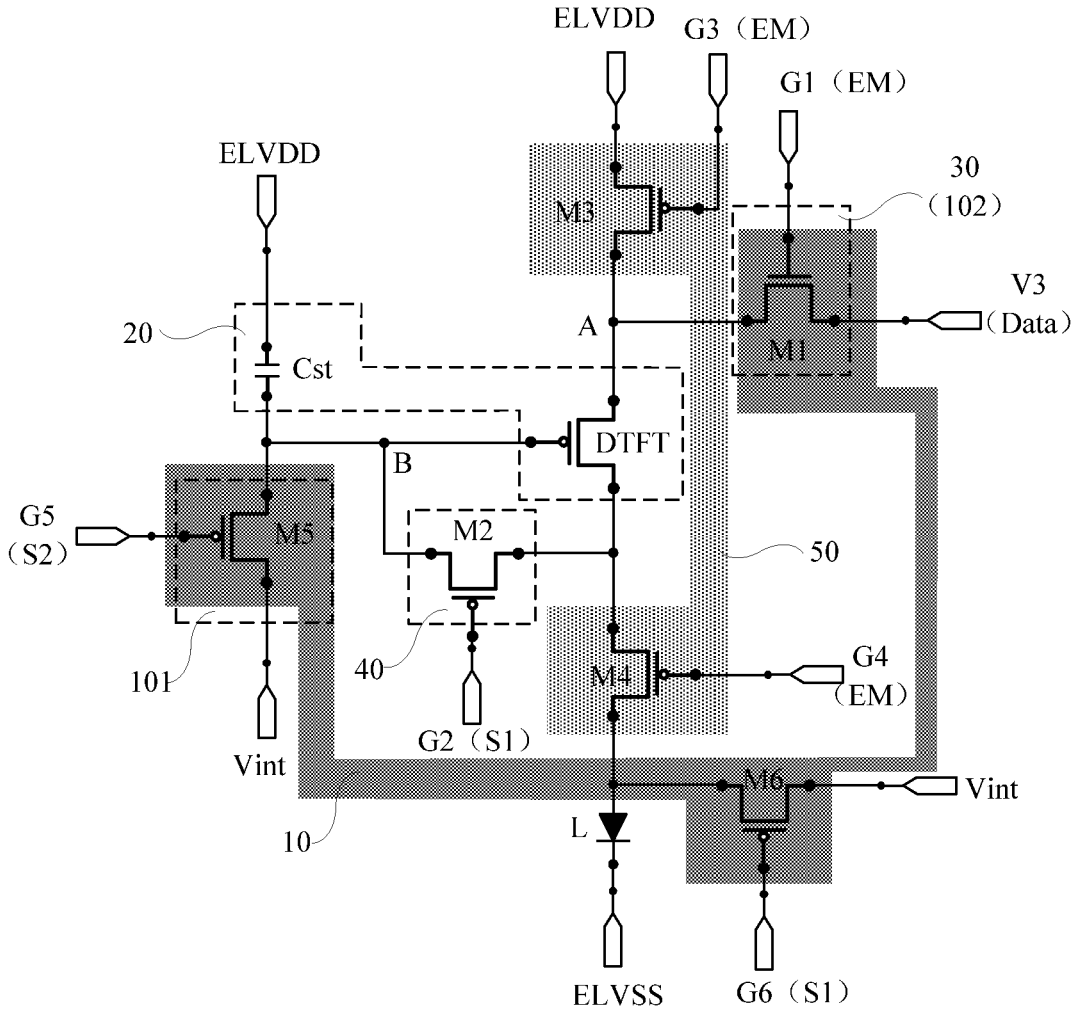
FIG. 4 is a schematic diagram illustrating a first setting mode of a reset module in FIG. 3*a* or 3*b;*

On the basis of the above, as illustrated in FIG. 4, the gate electrode reset sub-module 101 includes a fifth transistor M5; a gate electrode of the fifth transistor M5 is connected with a fifth grating signal terminal G5; a first electrode is connected with the gate electrode of the DTFT; and a second electrode is connected with the initial voltage terminal Vint.

On the basis of the above, the third voltage terminal V3 is connected with the data voltage terminal Data. Moreover, when the reset module 10 includes the first electrode reset sub-module 102, and the write module 30 is reused as the first electrode reset sub-module 102. At this point, the first electrode reset sub-module 102 includes the first transistor M1.

In addition, when the reset module 10 is also connected with the anode of the light-emitting element L, the reset module 10 further includes a sixth transistor M6. A gate electrode of the sixth transistor M6 is connected with a sixth gate signal terminal G6; a first electrode is connected with the anode of the light-emitting element L; and a second electrode is connected with the initial voltage terminal Vint.

Figure 5A:
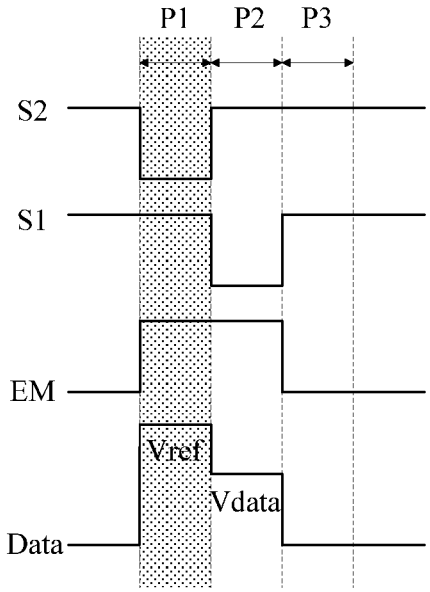
FIG. 5*a* is a timing signal diagram of driving signals for controlling the pixel circuit as illustrated in FIG. 4.
Figure 6A:
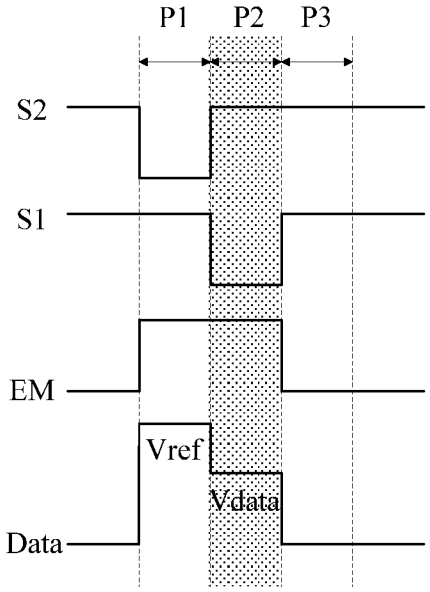
FIG. 6*a* is another timing signal diagram of the driving signals for controlling the pixel circuit as illustrated in FIG. 4.
Figure 7A:
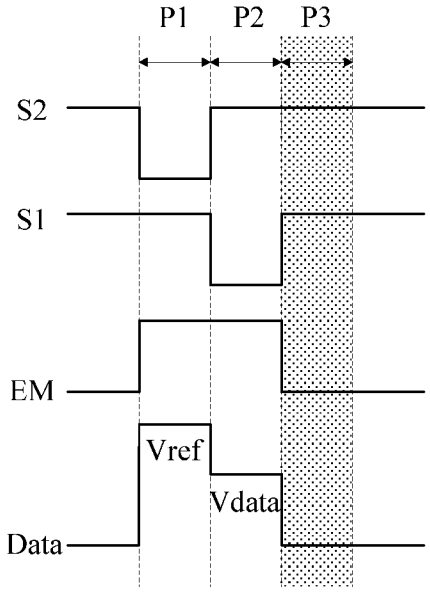
FIG. 7*a* is still another timing signal diagram of the driving signals for controlling the pixel circuit as illustrated in FIG. 4.

Detailed description will be given below to the working process of the pixel circuit as illustrated in FIG. 4 within one image frame with reference to the timing diagrams of the signal terminals as illustrated in FIGS. 5*a*, 6*a* and 7*a* respectively.

The first embodiment takes the case in which the first transistor M1 is an N-type transistor; the remaining transistors are P-type transistors, and the transistors are enhancement transistors, as an example.

In addition, as illustrated in FIG. 4, the first gate signal terminal G1 connected with the gate electrode of the first transistor M1, the third gate signal terminal G3 connected with the gate electrode of the third transistor M3, and the fourth gate signal terminal G4 connected with the fourth transistor M4 all receive signals outputted by the luminescent control signal terminal EM; the second gate signal terminal G2 connected with the gate electrode of the second transistor M2 and the sixth gate signal terminal G6 connected with the gate electrode of the sixth transistor M6 receive signals outputted by a first scanning signal terminal S1; and the fifth gate signal terminal G5 connected with the gate electrode of the fifth transistor M5 receives signals outputted by a second scanning signal terminal S2.

The one image frame includes the reset period P1, the write compensation period P2, and the light emission period P3.

More specifically, in the reset period P1 of one image frame, as illustrated in FIG. 5*a*, S2=0, S1=1, EM=1, Data=Vref. In the embodiment of the present disclosure, "0" indicates a low level, and "1" indicates a high level.

Figure 5B:
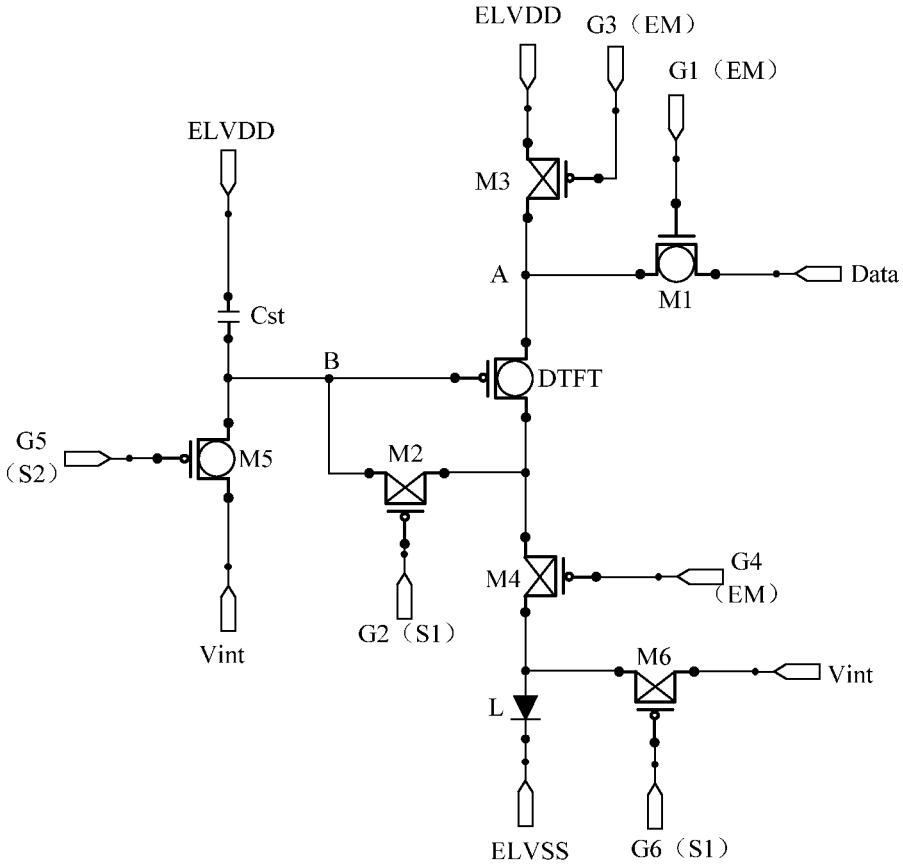
FIG. 5*b* illustrates the on-off condition of transistors in the pixel circuit as illustrated in FIG. 4 in the reset period as illustrated in FIG. 5*a;*

In this case, as illustrated in FIG. 5*b*, under the control of the low level signal outputted by the second scanning signal terminal S2, the fifth transistor M5 is switched on, and the initial voltage outputted by the initial voltage terminal Vint is transmitted to the gate electrode of the DTFT through the fifth transistor M5. At this point, the gate voltage of the DTFT is $Vg=V_B=Vint$.

In addition, as the first transistor M1 is an N-type transistor, under the control of the high level signal outputted by the luminescent control signal terminal EM, the first transistor M1 is switched on, so that the reference voltage Vref outputted by the data voltage terminal Data can be transmitted to the source electrode of the DTFT through the first transistor M1. At this point, the source voltage of the DTFT is $Vs=V_A=Vref$.

On the basis of the above, as illustrated in FIG. 5*a*, by adjustment of Vref, the gate-source voltage of the DTFT can be $Vgs=Vg-Vs=Vint-Vref<Vth$, so that the DTFT can be in the on-bias state. In this way, when the pixel circuit in each sub-pixel undergoes the reset period P1, the DTFTs in the sub-pixels are in the same ON-Bias state.

In addition, the remaining transistors are all in the off-state.

In the write compensation period P2 of one image frame, as illustrated in FIG. 6*a*, S2=1, S1=0, EM=1, Data=Vdata.

Figure 6B:
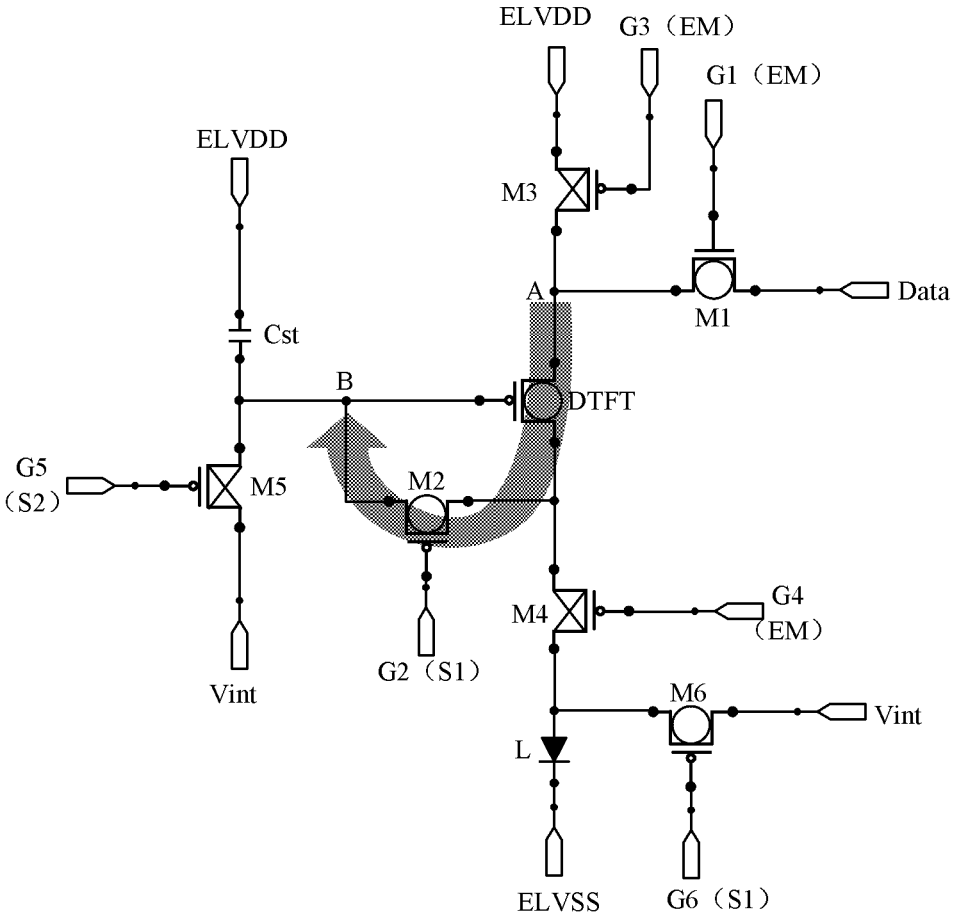
FIG. 6*b* illustrates the on-off condition of the transistors in the pixel circuit as illustrated in FIG. 4 in the write compensation period as illustrated in FIG. 6*a;*

In this case, as illustrated in FIG. 6*b*, under the control of the luminescent control signal terminal EM, the first transistor M1 maintains the on-state, and at this point, the data voltage Vdata outputted by the data voltage terminal Data is transmitted to the source electrode of the DTFT through the first transistor M1. At this moment, the source voltage of the DTFT is $Vs=V_A=Vdata$, so the write of the data voltage can be realized.

On the basis of the above, the storage capacitor Cst may maintain the node B as a low level, and at this point, the DTFT is switched on. On the basis of the above, under the control of the first scanning signal terminal S1, the second transistor M2 is switched on. At this point, the gate voltage Vg and the drain voltage Vd of the DTFT are the same, namely Vg=Vd. At this moment, $Vgd=Vg-Vd=0>Vth$, and Vth is a negative value. Thus, the DTFT is in the saturated state.

In this case, the data voltage Vdata of the data voltage terminal Data charges the gate electrode (namely the point B) of the DTFT through the first transistor M1, the DTFT and the second transistor M2, until the voltage of the point B reaches Vdata+Vth. Therefore, when $V_B=Vdata+Vth$, the gate-source voltage of the DTFT is $Vgs=Vg-Vs=Vdata+Vth-Vdata=Vth$, and at this point, the DTFT is in the off-state. As for a P-type enhancement transistor, the off condition is $Vgs>Vth$, and Vth is a negative value. In this way, the threshold voltage Vth of the DTFT is locked to the gate electrode of the DTFT, so that the threshold voltage Vth of the DTFT can be compensated.

In addition, under the control of the first scanning signal terminal S1, the sixth transistor M6 is switched on, so that the initial voltage of the initial voltage terminal Vint can be outputted to the anode of the light-emitting element L through the sixth transistor M6. The contrast of the display image is improved by the reset of the anode of the light-emitting element L. The remaining transistors are in the off-state.

In the light emission period P3 of one image frame, as illustrated in FIG. 7*a*, S2=1, S1=1, EM=0, and Data=0.

Figure 7B:
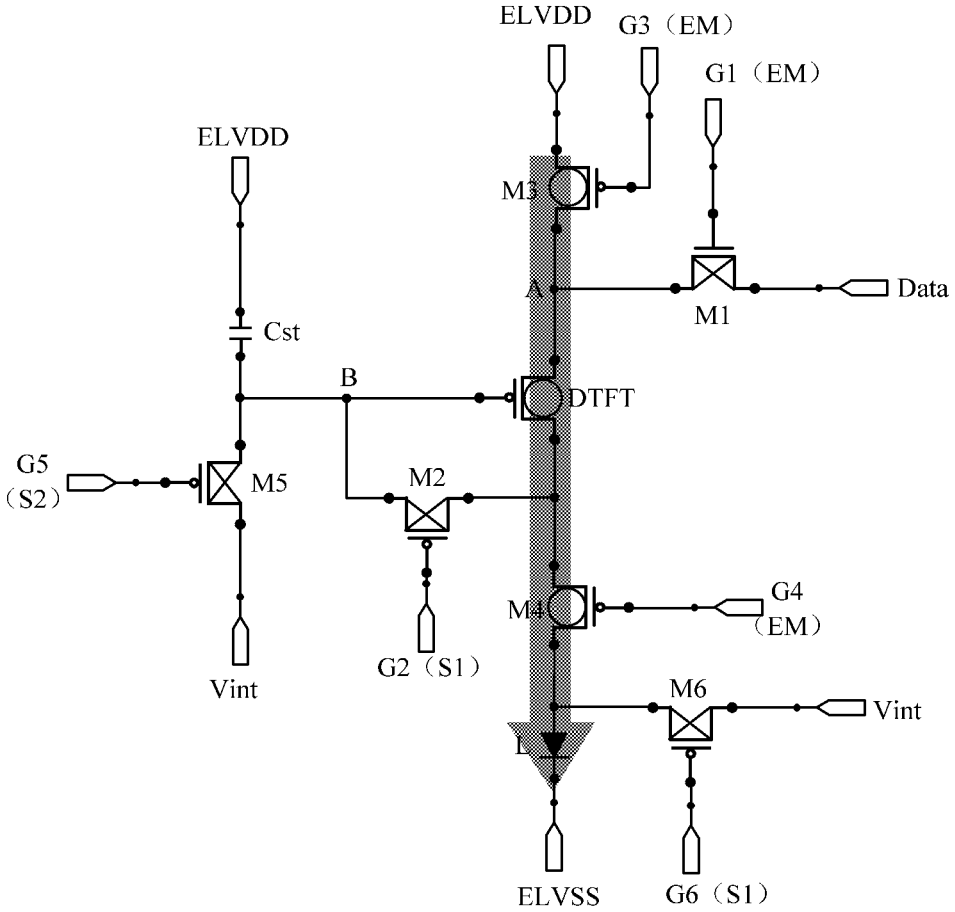
FIG. 7*b* illustrates the on-off condition of the transistors in the pixel circuit as illustrated in FIG. 4 in the light emission period as illustrated in FIG. 7*a;*

In this case, as illustrated in FIG. 7*b*, under the control of the luminescent control signal terminal EM, the third transistor M3 and the fourth transistor M4 are switched on. At this point, the voltage of the point A is $V_A=ELVDD$. Under the action of the storage capacitor Cst, the voltage of the point B maintains $V_B=Vdata+Vth$. At this point, the gate-source voltage of the DTFT is $Vgs=Vg-Vs=V_B-V_A=(Vdata+Vth)-ELVDD=Vdata+Vth-ELVDD<Vth$, and Vth is a negative value. Thus, the DTFT is switched on. In addition, the remaining transistors are in the off-state.

On the basis of the above, the drive current I flowing across the light-emitting element L is:

$$\begin{aligned} I_{OLED} &= K/2\times(Vgs-Vth)^2 \\ &= K/2\times(Vdata+Vth-ELVDD-Vth)^2 \\ &= K/2\times(Vdata-ELVDD)^2 \end{aligned} \quad (1)$$

wherein K refers to the current constant associated with the DTFT and is relevant to the process parameters and the physical dimension of the DTFT, for example, electron mobility p, capacitance $C_{ox}$ per unit area, and width to length ratio W/L.

In the technical proposal known to the inventor, the drift of the threshold voltage Vth of the DTFTs among different pixel units results in different threshold voltage Vth of the DTFTs. As known from the above formula (1), the drive current $I_{OLED}$ for driving the light-emitting element L to emit light is irrelevant to the threshold voltage Vth of the DTFT, so as to eliminate the impact of the threshold voltage Vth of the DTFT on the luminous brightness of the light-emitting element L and improve the brightness uniformity of the light-emitting element L.

It should be noted that description is given above by taking the case in which the first transistor M1 is an N-type transistor and the remaining transistors are P-type transistors as an example. When the first transistor M1 is a P-type transistor and the remaining transistors are N-type transistors, the control process can be similarly obtained, but partial control signals must be transformed.

Second Embodiment

In the embodiment, the setting modes of the write module 30, the compensation module 40 and the luminescent control module 50 are as described above, so no further description will be given here.

Figure 8:
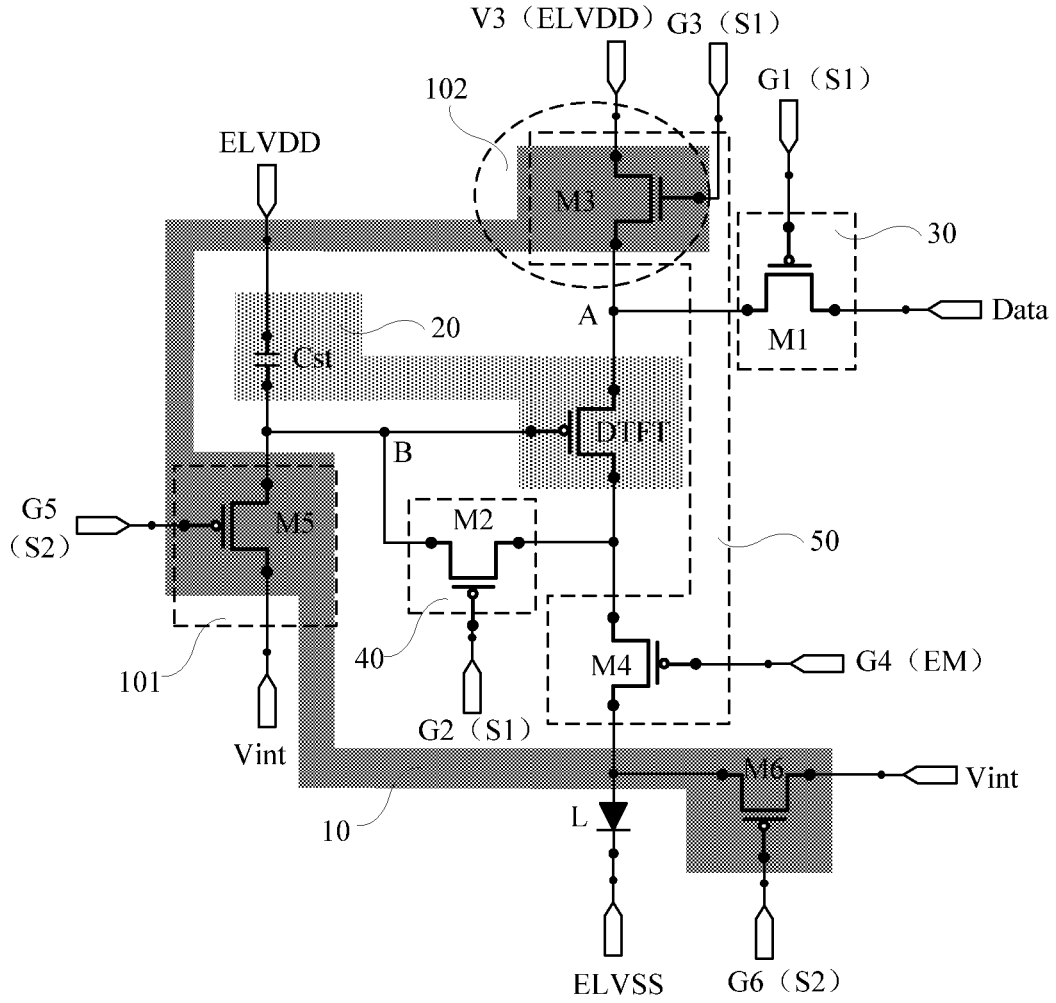
FIG. 8 is a schematic diagram illustrating a second setting mode of the reset module in FIG. 3*a* or 3*b;*

In addition, as illustrated in FIG. 8, the gate electrode reset sub-module 101 includes the fifth transistor M5. The connecting mode of the fifth transistor is the same as that in the first embodiment.

On the basis of the above, the third voltage terminal V3 is connected with the first voltage terminal ELVDD, and when the reset module 10 includes the first electrode reset sub-module 102, one part of the luminescent control module 50 is reused as the first electrode reset sub-module 102. At this point, the first electrode reset sub-module 102, as illustrated in FIG. 8, includes the third transistor M3.

In addition, the pixel circuit in the embodiment may further comprise the sixth transistor M6 as the same as the first embodiment.

Figure 9A:
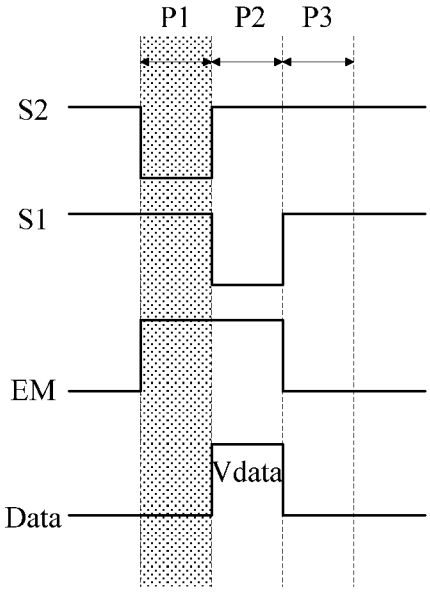
FIG. 9*a* is a timing signal diagram of driving signals for controlling the pixel circuit as illustrated in FIG. 8.
Figure 10A:
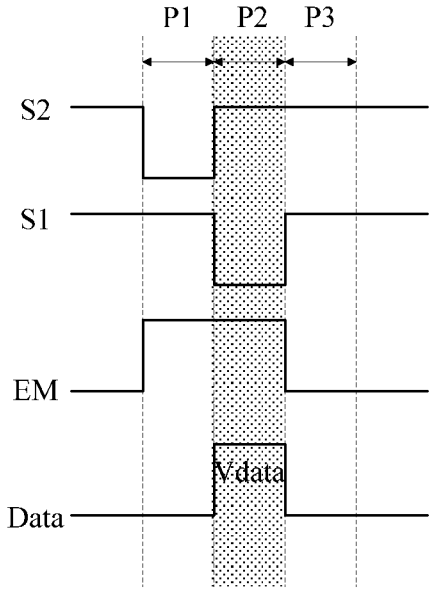
FIG. 10*a* is another timing signal diagram of the driving signals for controlling the pixel circuit as illustrated in FIG. 8.
Figure 11A:
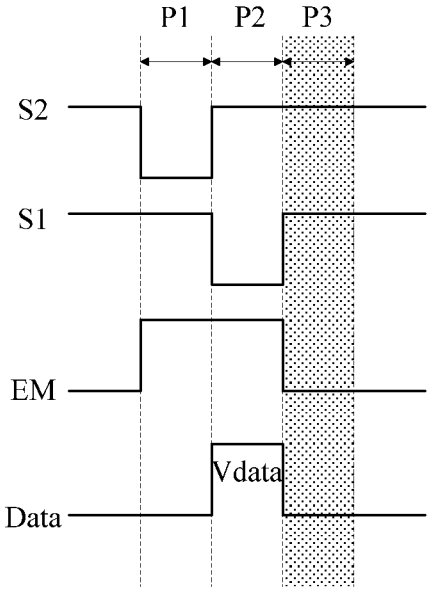
FIG. 11*a* is still another timing signal diagram of the driving signals for controlling the pixel circuit as illustrated in FIG. 8.

Detailed description will be given below to the working process of the pixel circuit as illustrated in FIG. 8 within one image frame with reference to the timing diagrams of the signal terminals as illustrated in FIGS. 9*a*, 10*a* and 11*a* respectively.

The second embodiment takes the case in which the third transistor M3 is an N-type transistor; the remaining transistors are P-type transistors, and the transistors are enhancement transistors, as an example.

In addition, as illustrated in FIG. 8, the first gate signal terminal G1 connected with the gate electrode of the first transistor M1, the third gate signal terminal G3 connected with the gate electrode of the third transistor M3, and the second gate signal terminal G2 connected with the gate electrode of the second transistor M2 all receive signals outputted by the first scanning signal terminal S1; the fourth gate signal terminal G4 connected with the fourth transistor M4 receives signals outputted by the luminescent control signal terminal EM; and the fifth gate signal terminal G5 connected with the gate electrode of the fifth transistor M5 and the sixth gate signal terminal G6 connected with the gate electrode of the sixth transistor M6 receive signals outputted by the second scanning signal terminal S2.

More specifically, in the reset period P1 of one image frame, as illustrated in FIG. 9*a*, S2=0, S1=1, EM=1, and Data=0.

Figure 9B:
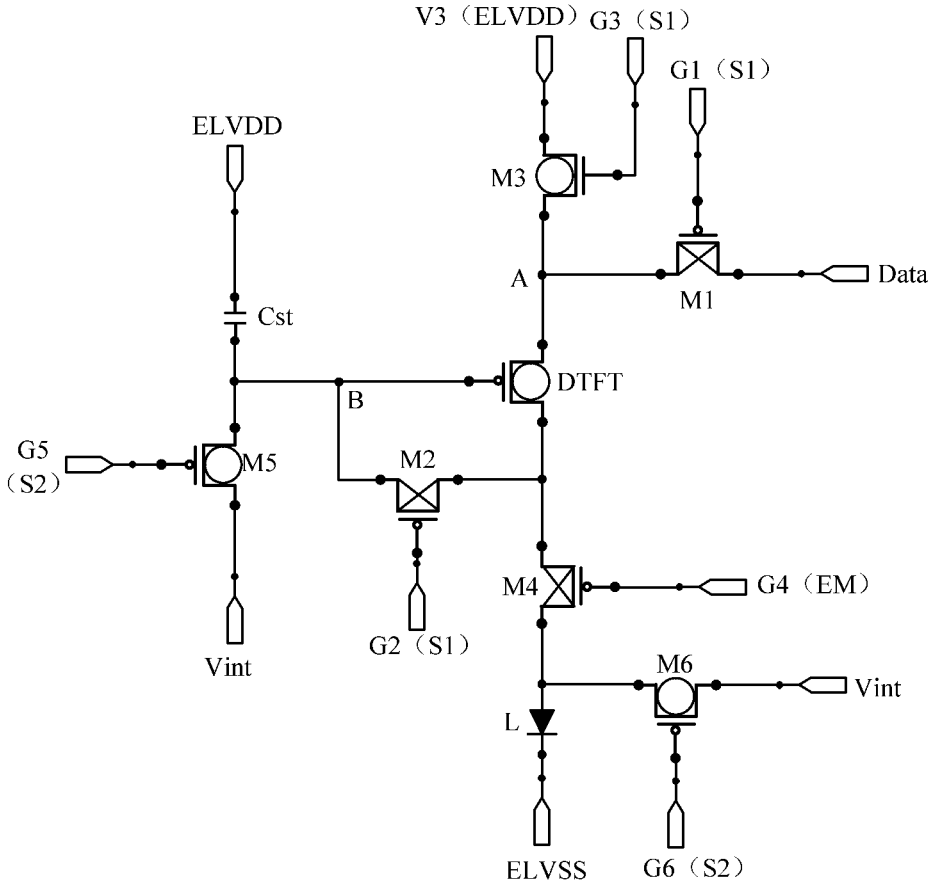
FIG. 9*b* illustrates the on-off condition of transistors in the pixel circuit as illustrated in FIG. 8 in the reset period as illustrated in FIG. 9*a;*

In this case, as illustrated in FIG. 9*b*, under the control of the low level outputted by the second scanning signal terminal S2, the fifth transistor M5 and the sixth transistor M6 are switched on. The initial voltage of the initial voltage terminal Vint is transmitted to the gate electrode of the DTFT through the fifth transistor M5 and transmitted to the anode of the light-emitting element L through the sixth transistor M6, so as to respectively reset the gate electrode of the DTFT and the anode of the light-emitting element L. At this point, the gate voltage of the DTFT is $Vg=V_B=Vint$.

In addition, under the control of the first scanning signal terminal S1, the third transistor M3 is switched on, and the source voltage of the DTFT is $Vs=V_A=ELVDD$.

On the basis of the above, the gate-source voltage of the DTFT is Vgs=Vg−Vs=Vint−ELVDD<Vth, so that the DTFT can be in the on-bias state. In addition, the remaining transistors are in the off-state.

In the write compensation period P2 of one image frame, as illustrated in FIG. 10*a*, S2=1, S1=0, EM=1, Data=Vdata.

Figure 10B:
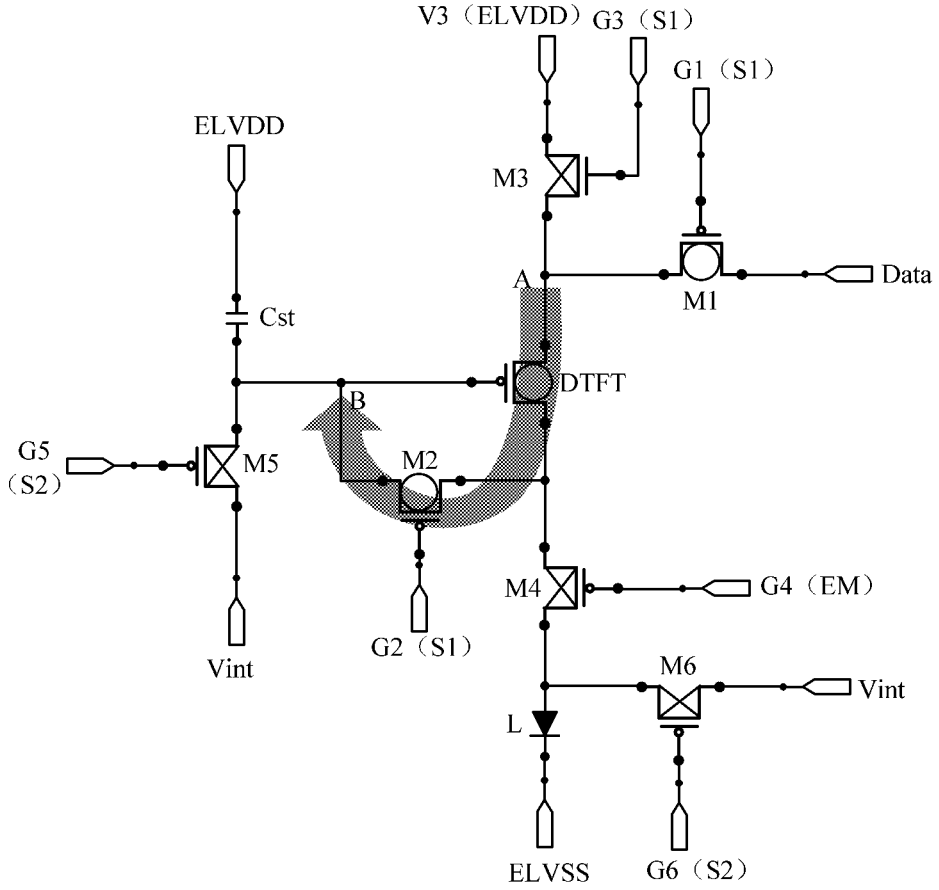
FIG. 10*b* illustrates the on-off condition of the transistors in the pixel circuit as illustrated in FIG. 8 in the write compensation period as illustrated in FIG. 10*a;*

In this case, as illustrated in FIG. 10*b*, under the control of the first scanning signal terminal S1, the second transistor M2 and the first transistor M1 are switched on. The data voltage Vdata outputted by the data voltage terminal Data is transmitted to the source electrode of the DTFT through the first transistor M1. At this point, the source voltage of the DTFT is $Vs=V_A=Vdata$, so as to realize the write of the data voltage.

Due to the switched-on second transistor M2, the gate voltage Vg and the drain voltage Vd of the DTFT are the same, namely Vg=Vd. In this case, the data voltage Vdata of the data voltage terminal Data charges the gate electrode (namely the point B) of the DTFT through the first transistor M1, the DTFT and the second transistor M2, until the voltage of the point B reaches Vdata+Vth. In this way, the threshold voltage Vth of the DTFT is locked to the gate electrode of the DTFT, so that the threshold voltage Vth of the DTFT can be compensated. In addition, the remaining transistors are in the off-state.

In the light emission period P3 of one image frame, as illustrated in FIG. 11*a*, S2=1, S1=1, EM=0, and Data=0.

Figure 11B:
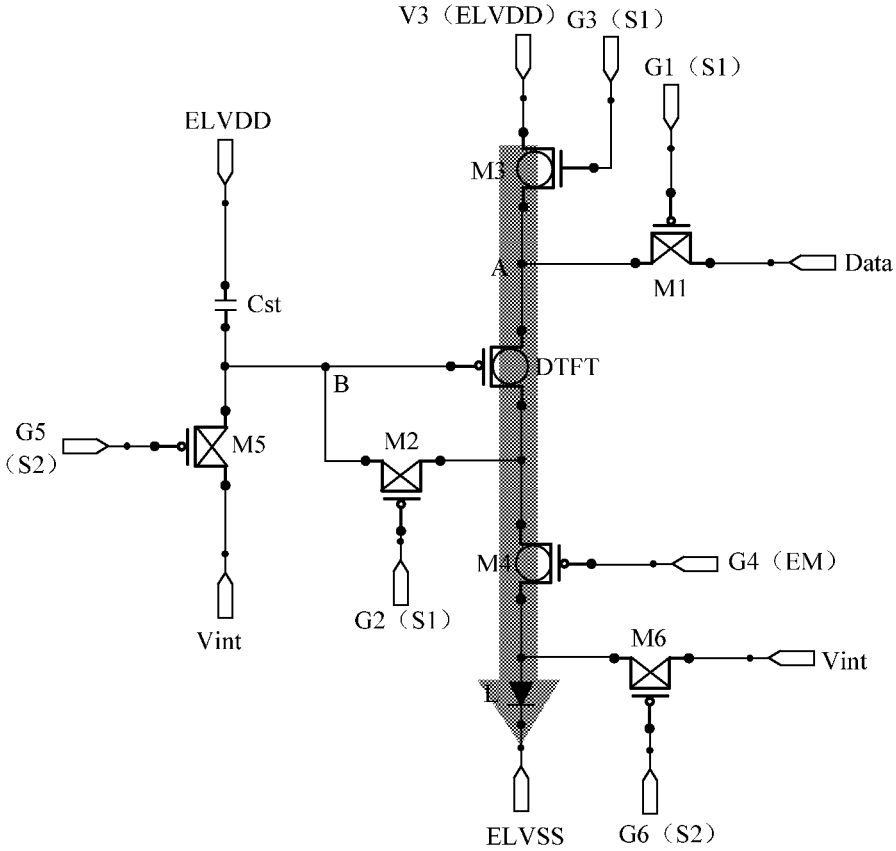
FIG. 11*b* illustrates the on-off condition of the transistors in the pixel circuit as illustrated in FIG. 8 in the light emission period as illustrated in FIG. 11*a;*

In this case, as illustrated in FIG. 11*b*, under the control of the luminescent control signal terminal EM, the fourth transistor M4 is switched on; and under the control of the first scanning signal terminal S1, the third transistor M3 is switched on. At this point, the voltage of the point A is $V_A=ELVDD$. The voltage of the point B maintains $V_B=Vdata+Vth$. At this moment, the gate-source voltage of the DTFT is $Vgs=Vg-Vs=V_B-V_A=(Vdata+Vth)-ELVDD=Vdata+Vth-ELVDD<Vth$, and Vth is a negative value. Thus, the DTFT is switched on. In addition, the remaining transistors are in the off-state.

On the basis of the above, the drive current $I_{OLED}$ flowing across the light-emitting element L is the same as the above formula (1). Thus, the drive current $I_{OLED}$ for driving the light-emitting element L to emit light is irrelevant to the threshold voltage Vth of the DTFT.

It should be noted that description is given above by taking the case in which the third transistor M3 is an N-type transistor and the remaining transistors are P-type transistors as an example. When the third transistor M3 is a P-type transistor and the remaining transistors are N-type transistors, the control process can be similarly obtained, but part of control signals must be reversed.

Third Embodiment

In the embodiment, the setting modes of the write module 30, the compensation module 40 and the luminescent control module 50 are as described above, so no further description will be given here.

Figure 12:
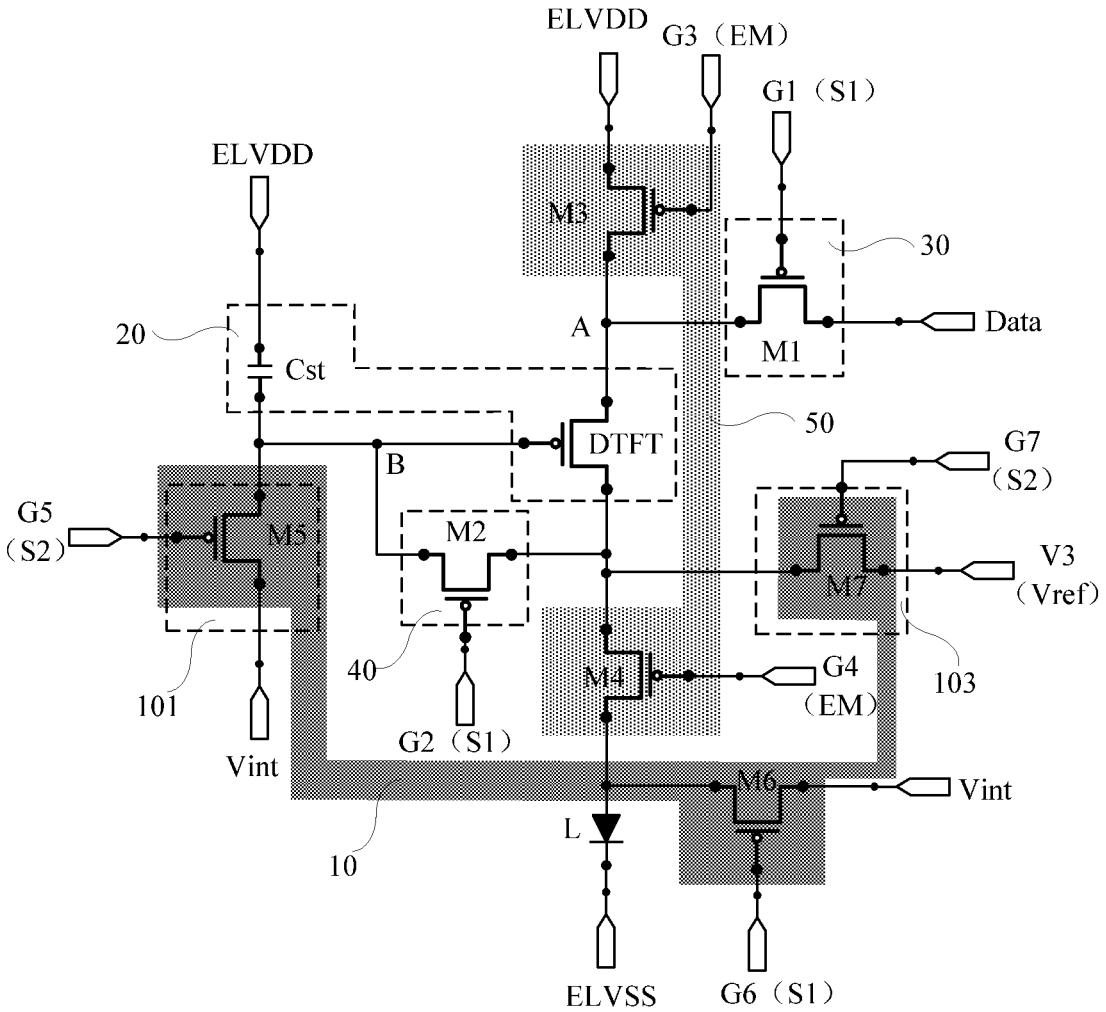
FIG. 12 is a schematic diagram illustrating a third setting mode of the reset module in FIG. 3*a* or 3*b;*

In addition, as illustrated in FIG. 12, the gate electrode reset sub-module 101 includes the fifth transistor M5. The connecting mode of the fifth transistor is the same as the first embodiment.

On the basis of the above, the third voltage terminal V3 is connected with the reference voltage terminal Vref, and when the reset module 10 includes the second electrode reset sub-module 102, the second electrode reset sub-module 102 includes a seventh transistor M7. A gate electrode of the seventh transistor M7 is connected with a seventh control signal terminal G7; a first electrode is connected with the reference voltage terminal Vref; and a second electrode is connected with the second electrode of the DTFT.

In addition, the pixel circuit in the embodiment may further comprise the sixth transistor M6 as the same as the first embodiment.

Detailed description will be given below to the working process of the pixel circuit as illustrated in FIG. 12 within one image frame with reference to the timing diagrams of the signal terminals as illustrated in FIGS. 9*a*, 10*a* and 11*a* respectively.

The third embodiment takes the case in which all the transistors are P-type transistors and are enhancement transistors as an example.

In addition, as illustrated in FIG. 12, the first gate signal terminal G1 connected with the gate electrode of the first transistor M1, the second gate signal terminal G2 connected with the gate electrode of the second transistor M2, and the sixth gate signal terminal G6 connected with the gate electrode of the sixth transistor M6 all receive signals outputted by the first scanning signal terminal S1; both the third gate signal terminal G3 connected with the gate electrode of the third transistor M3 and the fourth gate signal terminal G4 connected with the fourth transistor M4 receive signals outputted by the luminescent control signal terminal EM; and the fifth gate signal terminal G5 connected with the gate electrode of the fifth transistor M5 and the seventh gate signal terminal G7 connected with the gate electrode of the seventh transistor M7 receive signals outputted by the second scanning signal terminal S2.

More specifically, in the reset period P1 of one image frame, as illustrated in FIG. 9*a*, S2=0, S1=1, EM=1, and Data=0.

Figure 13A:
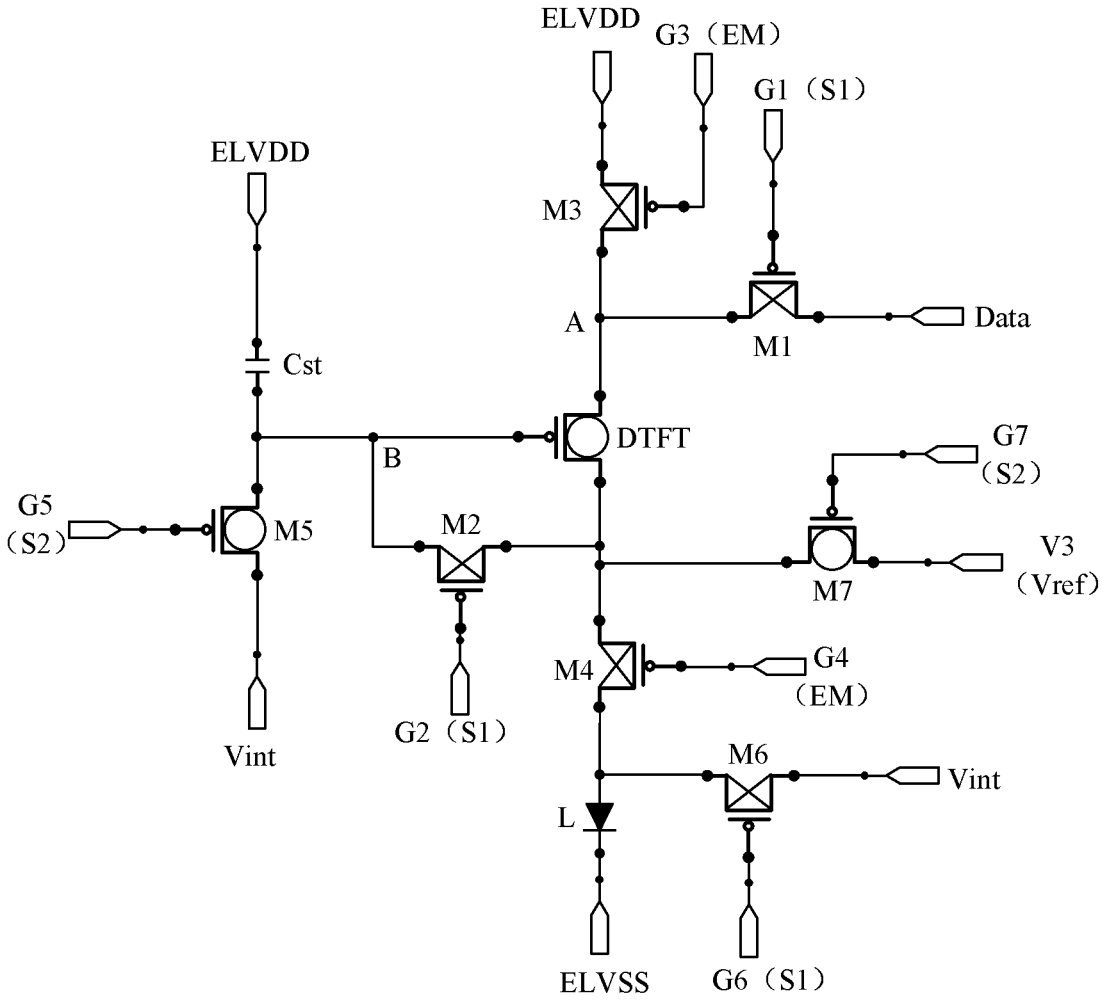
FIGS. 13*a*, 13*b* and 13*c* are respectively working diagrams of the pixel circuit as illustrated in FIG. 12 in the reset period, the write compensation period and the light emission period.

In this case, as illustrated in FIG. 13*a*, under the control of the low level outputted by the second scanning signal terminal S2, the fifth transistor M5 and the seventh transistor M7 are switched on. The initial voltage of the initial voltage terminal Vint is transmitted to the gate electrode of the DTFT through the fifth transistor M5, and at this point, the gate voltage of the DTFT is Vg=VB=Vint. In addition, the voltage of the reference voltage terminal Vref is transmitted to the drain electrode of the DTFT through the ON-Bias seventh transistor M7. Thus, the DTFT is in the on-bias state, so the source voltage of the DTFT is Vs=VA=Vref.

On the basis of the above, the gate-source voltage of the DTFT is Vgs=Vg−Vs=Vint−Vref<Vth, so that the DTFT can be in the on-bias state. In addition, the remaining transistors are in the off-state.

In the write compensation period P2 of one image frame, as illustrated in FIG. 10*a*, S2=1, S1=0, EM=1, Data=Vdata.

Figure 13B:
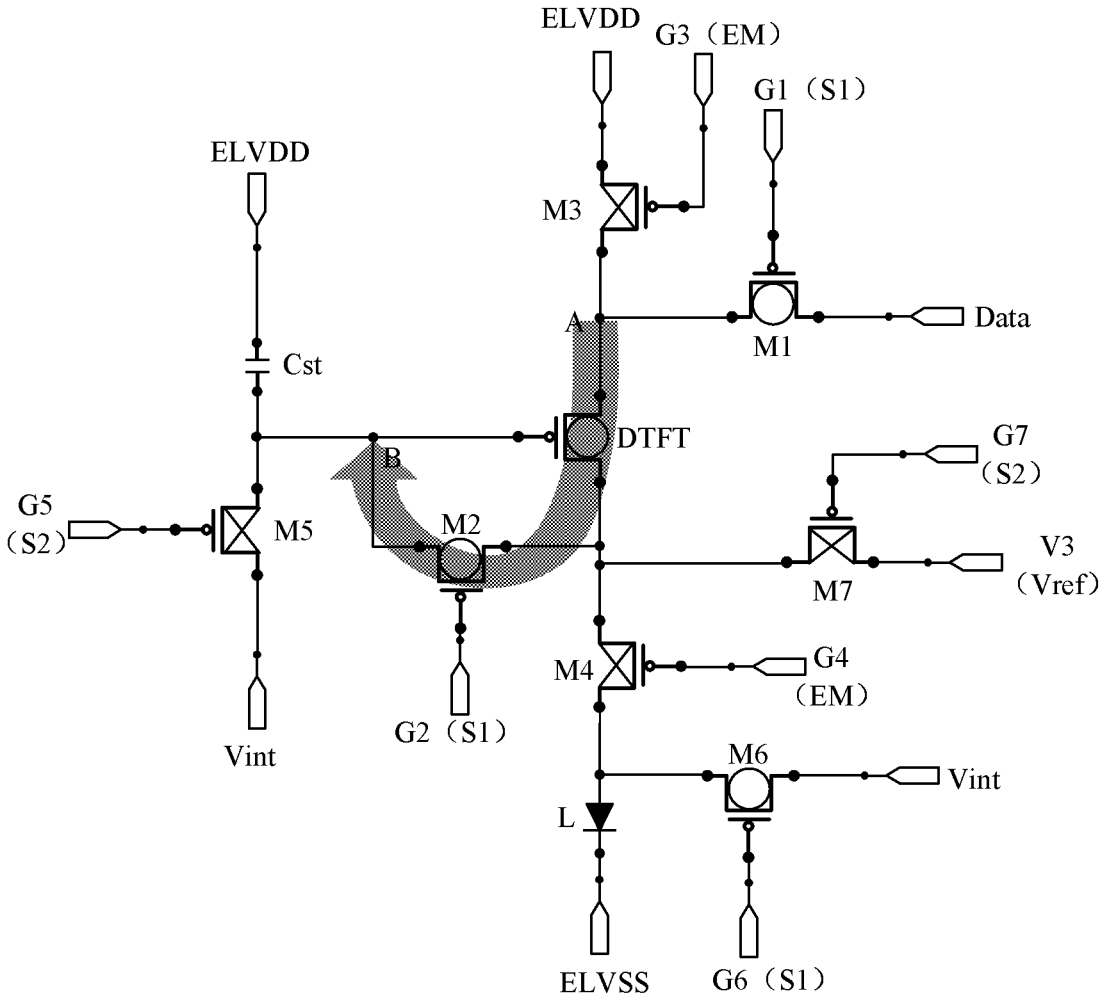

In this case, as illustrated in FIG. 13*b*, under the control of the first scanning signal terminal S1, the second transistor M2, the first transistor M1 and the sixth transistor M6 are switched on. The data voltage Vdata outputted by the data voltage terminal Data is transmitted to the source electrode of the DTFT through the first transistor M1. At this point, the source voltage of the DTFT is Vs=$V_A$=Vdata, so as to realize the write of the data voltage.

Due to the switched-on second transistor M2, the gate voltage Vg and the drain voltage Vd of the DTFT are the same, namely Vg=Vd. In this case, the data voltage Vdata of the data voltage terminal Data charges the gate electrode (namely the point B) of the DTFT through the first transistor M1, the DTFT and the second transistor M2, until the voltage of the point B reaches Vdata+Vth. In this way, the threshold voltage Vth of the DTFT is locked to the gate electrode of the DTFT, so that the threshold voltage Vth of the DTFT can be compensated.

In addition, the initial voltage of the initial voltage terminal Vint is transmitted to the anode of the light-emitting element L through the ON-Bias sixth transistor M6, and the anode is reset. In addition, the remaining transistors are in off-state.

In the light emission period P3 of one image frame, as illustrated in FIG. 11*a*, S2=1, S1=1, EM=0, and Data=0.

Figure 13C:
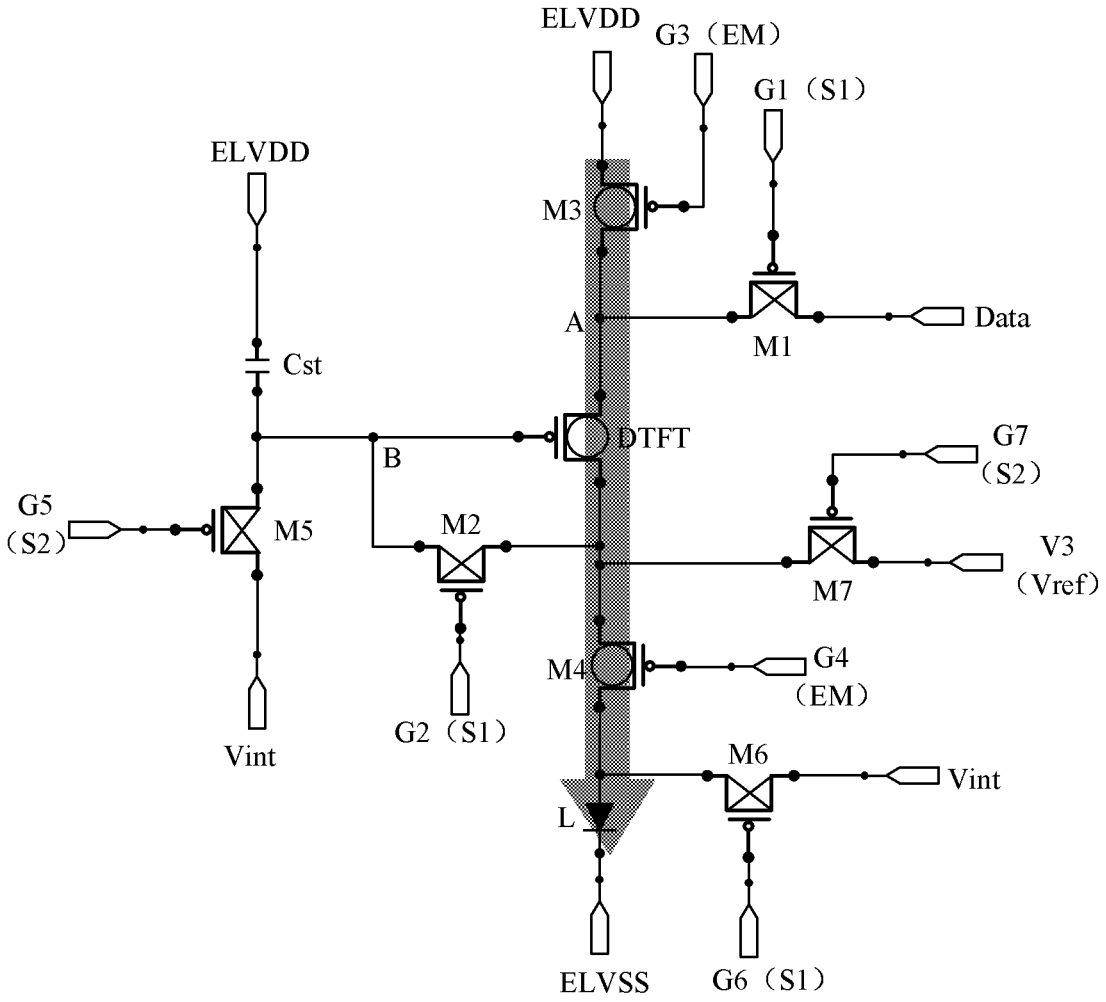

In this case, as illustrated in FIG. 13*c*, under the control of the luminescent control signal terminal EM, the third transistor M3 and the fourth transistor M4 are switched on. At this point, the voltage of the point A is $V_A$=ELVDD. The voltage of the point B maintains $V_B$=Vdata+Vth. At this moment, the gate-source voltage of the DTFT is Vgs=Vg−Vs=$V_B$−$V_A$=(Vdata+Vth)−ELVDD=Vdata+Vth−ELVDD<Vth, and Vth is a negative value. Thus, the DTFT is switched on. In addition, the remaining transistors are in the off-state.

On the basis of the above, the drive current $I_{OLED}$ flowing across the light-emitting element L is the same as the above formula (1). Therefore, the drive current $I_{OLED}$ for driving the light-emitting element L to emit light is irrelevant to the threshold voltage Vth of the DTFT.

It should be noted that description is given above by taking the case in which all the transistors are P-type transistors as an example. When all the transistors are P-type transistors, the control process can be similarly obtained, but partial control signals must be reversed.

Fourth Embodiment

In the embodiment, the setting modes of the write module 30, the compensation module 40, and the luminescent control module 50 are as described above, so no further description will be given here.

Figure 14:
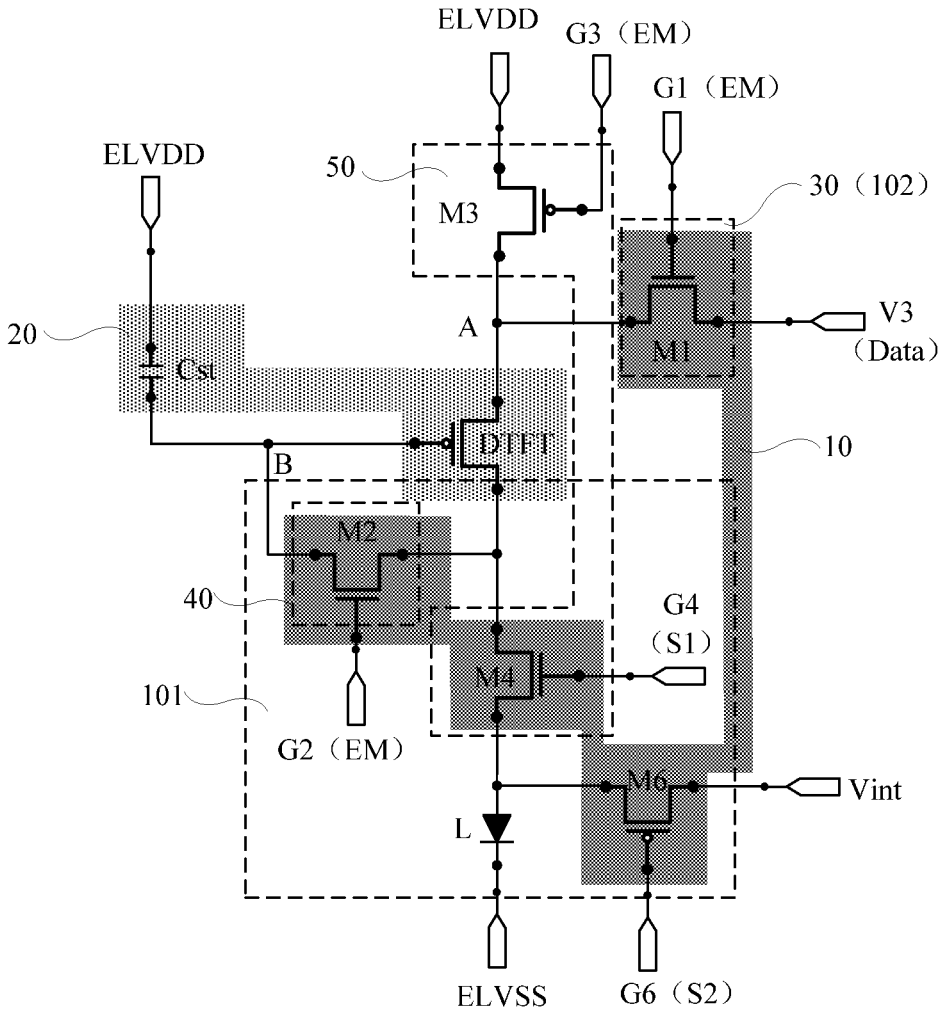
FIG. 14 is a schematic diagram illustrating a fourth setting mode of the reset module in FIG. 3*a* or 3*b;*

In addition, as illustrated in FIG. 14, when the reset module 10 is also connected with the anode of the light-emitting element L, the gate electrode reset sub-module 101 in the reset module 10 includes a sixth transistor M6; a gate electrode of the sixth transistor M6 is connected with a sixth gate signal terminal G6; a first electrode is connected with the anode of the light-emitting element L; and a second electrode is connected with the initial voltage terminal Vint.

In addition, the compensation module 40 is reused as one part of the gate electrode reset sub-module 101, and the gate electrode reset sub-module 101 further includes the second transistor M2. Moreover, one part of the luminescent control module 50 is reused as one part of the gate electrode reset sub-module 101, and the gate electrode reset sub-module 101 further includes the fourth transistor M4.

On the basis of the above, the third voltage terminal V3 is connected with the data voltage terminal Data, and when the reset module 10 includes the first electrode reset sub-module 102, the write module 30 is reused as the first electrode reset sub-module 102. In this case, the first electrode reset sub-module 102 includes the first transistor M1.

Detailed description will be given below to the working process of the pixel circuit as illustrated in FIG. 14 within one image frame with reference to the timing diagrams of the signal terminals as illustrated in FIGS. 5*a*, 6*a* and 7*a* respectively.

The fourth embodiment takes the case in which the first transistor M1, the second transistor M2 and the fourth transistor M4 are N-type transistors; the remaining transistors are P-type transistors, and the transistors are enhancement transistors, as an example.

In addition, as illustrated in FIG. 14, the first gate signal terminal G1 connected with the gate electrode of the first transistor M1, the second gate signal terminal G2 connected with the gate electrode of the second transistor M2, and the third gate signal terminal G3 connected with the gate electrode of the third transistor M3 all receive signals outputted by the luminescent control signal terminal EM; the fourth gate signal terminal G4 connected with the fourth transistor M4 receives signals outputted by the first scanning signal terminal S1; and the sixth gate signal terminal G6 connected with the sixth transistor M6 receives signals outputted by the second scanning signal terminal S2.

More specifically, in the reset period P1 of one image frame, as illustrated in FIG. 5*a*, S2=0, S1=1, EM=1, Data=Vref.

Figure 15A:
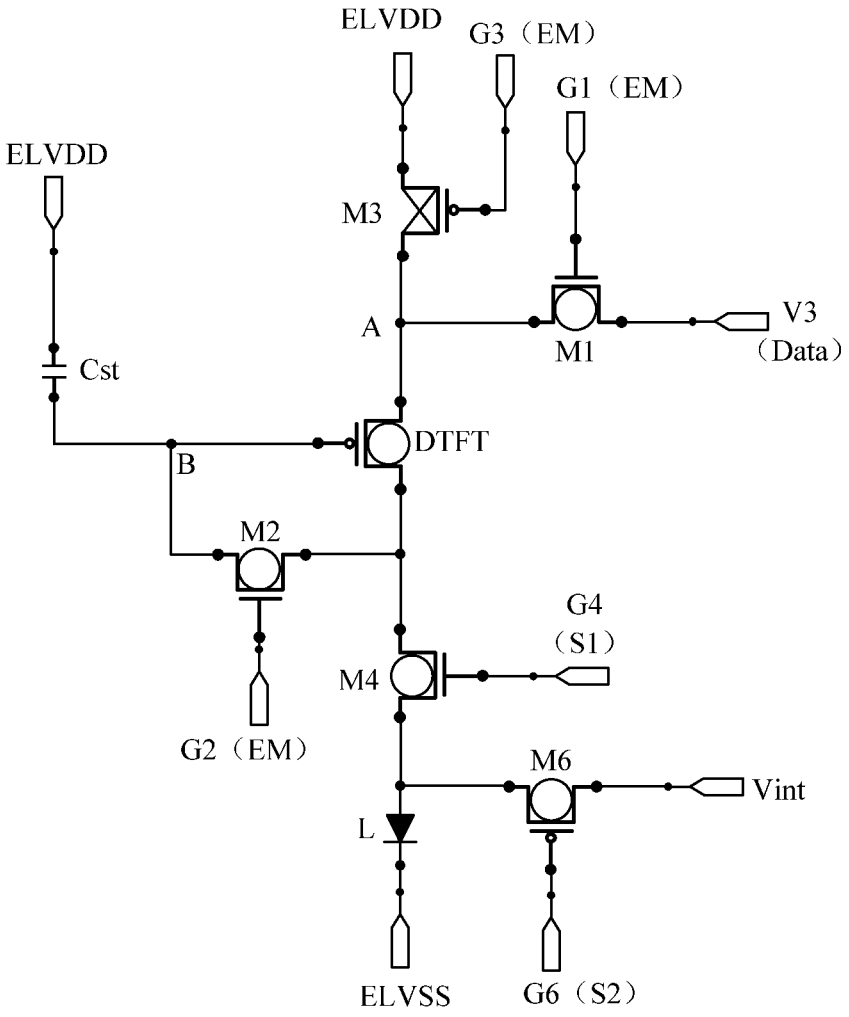
FIGS. 15*a*, 15*b* and 15*c* are respectively working diagrams of the pixel circuit as illustrated in FIG. 14 in the reset period, the write compensation period and the light emission period.

In this case, as illustrated in FIG. 15*a*, under the control of the luminescent control signal terminal EM, the first transistor M1 and the second transistor M2 are switched on; under the control of the first scanning signal terminal S1, the fourth transistor M4 is switched on; and under the control of the second scanning signal terminal S2, the sixth transistor M6 is switched on. At this point, the initial voltage of the initial voltage terminal Vint is transmitted to the drain electrode of the DTFT through the sixth transistor M6 and the fourth transistor M4 and transmitted to the gate electrode of the DTFT through the second transistor M2. At this moment, the gate voltage and the drain voltage of the DTFT are $Vg=Vd=V_B=Vint$, and the anode of the light-emitting element L is reset.

In addition, due to the switched-on first transistor M1, the source voltage of the DTFT is $Vs=V_A=Vref$.

On the basis of the above, the gate-source voltage of the DTFT is $Vgs=Vg-Vs=Vint-Vref<Vth$, and then the DTFT is in the on-bias state. In addition, the remaining transistors are in the off-state.

In the write compensation period P2 of one image frame, as illustrated in FIG. 6*a*, S2=1, S1=0, EM=1, Data=Vdata.

Figure 15B:
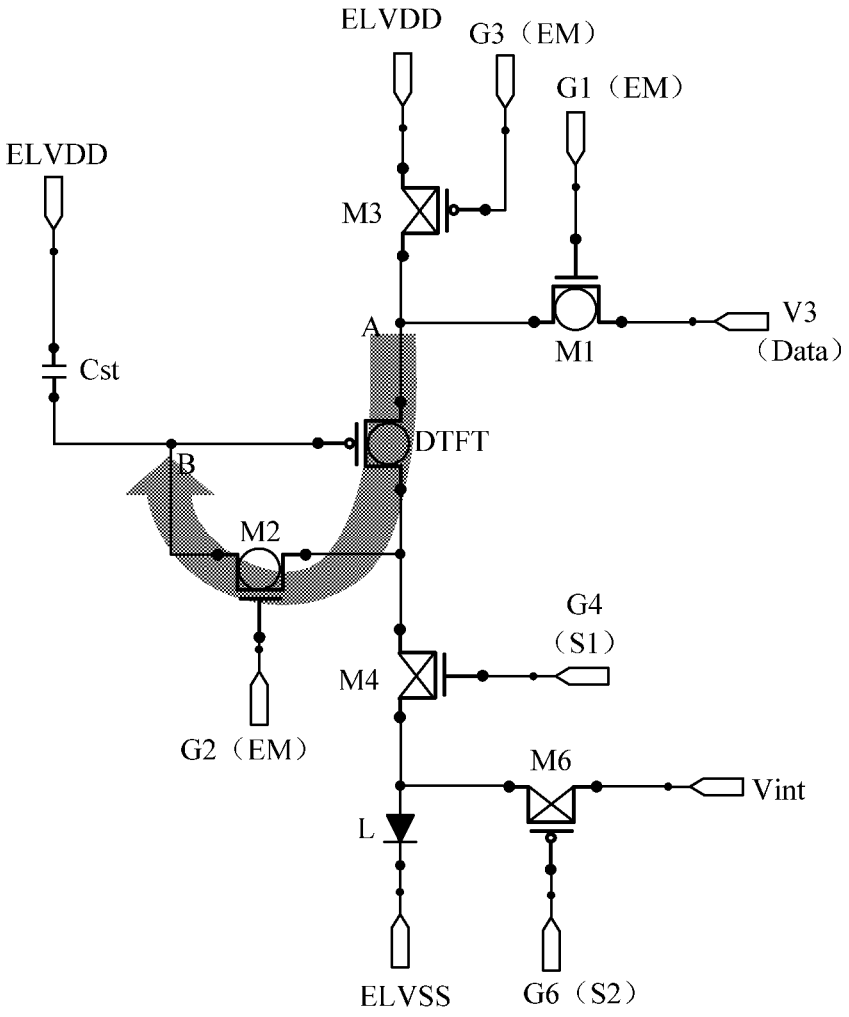

In this case, as illustrated in FIG. 15*b*, under the control of the luminescent control signal terminal EM, the first transistor M1 and the second transistor M2 maintains the on-state. The data voltage Vdata outputted by the data voltage terminal Data is transmitted to the source electrode of the DTFT through the first transistor M1. At this point, the source voltage of the DTFT is $Vs=V_A=Vdata$, so the write of the data voltage can be realized.

Due to the switched-on second transistor M2, the gate voltage Vg and the drain voltage Vd of the DTFT are the same, namely Vg=Vd. In this case, the data voltage Vdata of the data voltage terminal Data charges the gate electrode (namely the point B) of the DTFT through the first transistor M1, the DTFT and the second transistor M2, until the voltage of the point B reaches Vdata+Vth. In this way, the threshold voltage Vth of the DTFT is locked to the gate electrode of the DTFT, so that the threshold voltage Vth of the DTFT can be compensated.

In the light emission period P3 of one image frame, as illustrated in FIG. 7*a*, S2=1, S1=1, EM=0, and Data=0.

Figure 15C:
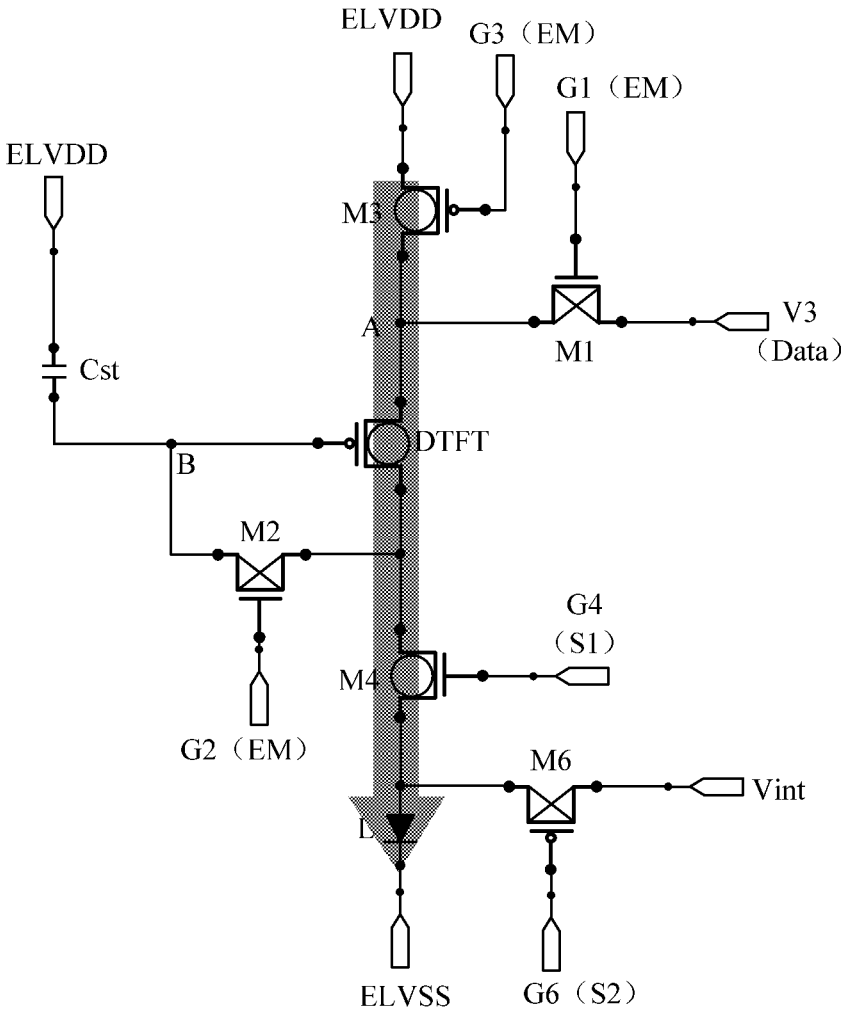

In this case, as illustrated in FIG. 15*c*, under the control of the luminescent control signal terminal EM, the third transistor M3 is switched on; and under the control of the first scanning signal terminal S1, the fourth transistor M4 is switched on. At this point, the voltage of the point A is $V_A=ELVDD$. The voltage of the point B maintains $V_B=Vdata+Vth$. At this moment, the gate-source voltage of the DTFT is $Vgs=Vg-Vs=V_B-V_A=(Vdata+Vth)-ELVDD=Vdata+Vth-ELVDD<Vth$, and Vth is a negative value. Thus, the DTFT is switched on. In addition, the remaining transistors are in the off-state.

On the basis of the above, the drive current $I_{OLED}$ flowing across the light-emitting element L is the same as the above formula (1). Thus, the drive current $I_{OLED}$ for driving the light-emitting element L to emit light is irrelevant to the threshold voltage Vth of the DTFT.

It should be noted that description is given above by taking the case in which the first transistor M1, the second transistor M2 and the fourth transistor M4 are N-type transistors and the remaining transistors are P-type transistors as an example. When the first transistor M1, the second transistor M2 and the fourth transistor M4 are P-type transistors and the remaining transistors are N-type transistors, the control process can be similarly obtained, but partial control signals must be reversed.

Fifth Embodiment

In the embodiment, the setting modes of the write module 30, the compensation module 40 and the luminescent control module 50 are the same as described above, so no further description will be given here.

Figure 16:
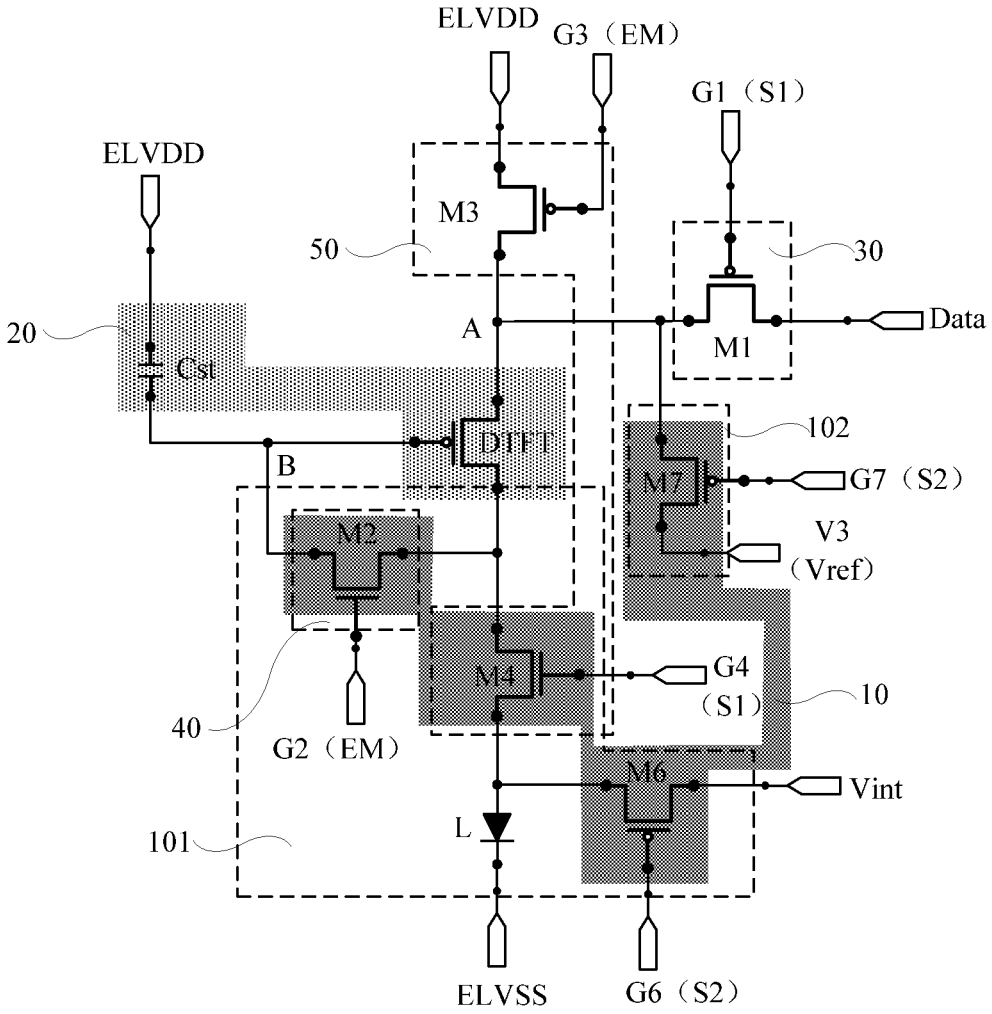
FIG. 16 is a schematic diagram illustrating a fifth setting mode of the reset module in FIG. 3*a* or 3*b*.

In addition, as illustrated in FIG. 16, the gate electrode reset sub-module 101 in the reset module 10 includes the sixth transistor M6, the second transistor shared with the compensation module 40, and the fourth transistor M4 shared with the luminescent control module 50. The setting modes of the sixth transistor M6, the second transistor and the fourth transistor M4 are the same as those in the fourth embodiment.

On the basis of the above, the third voltage terminal V3 is connected with the reference voltage terminal Vref, and when the reset module 10 includes the first electrode reset sub-module 102, the first electrode reset sub-module 102 includes a seventh transistor M7; a gate electrode of the seventh transistor M7 is connected with a seventh control signal terminal G7; a first electrode is connected with the reference voltage terminal Vref; and a second electrode is connected with the first electrode of the DFT.

Detailed description will be given below to the working process of the pixel circuit as illustrated in FIG. 16 within one image frame with reference to the timing diagrams of the signal terminals as illustrated in FIGS. 9*a*, 10*a* and 11*a* respectively.

The fifth embodiment takes the case in which the second transistor M2 and the fourth transistor M4 are N-type transistors, the remaining transistors being P-type transistors, the transistors being enhancement transistors, as an example.

In addition, as illustrated in FIG. 16, both the first gate signal terminal G1 connected with the gate electrode of the first transistor M1 and the fourth gate signal terminal G4 connected with the fourth transistor M4 receive signals outputted by the first scanning signal terminal S1; both the second gate signal terminal G2 connected with the gate electrode of the second transistor M2 and the third gate signal terminal G3 connected with the gate electrode of the third transistor M3 receive signals outputted by the luminescent control signal terminal EM; and both the sixth gate signal terminal G6 connected with the sixth transistor M6 and the seventh gate signal terminal G7 connected with the seventh transistor M7 receive signals outputted by the second scanning signal terminal S2.

More specifically, in the reset period P1 of one image frame, as illustrated in FIG. 9*a*, S2=0, S1=1, EM=1, and Data=0.

Figure 17A:
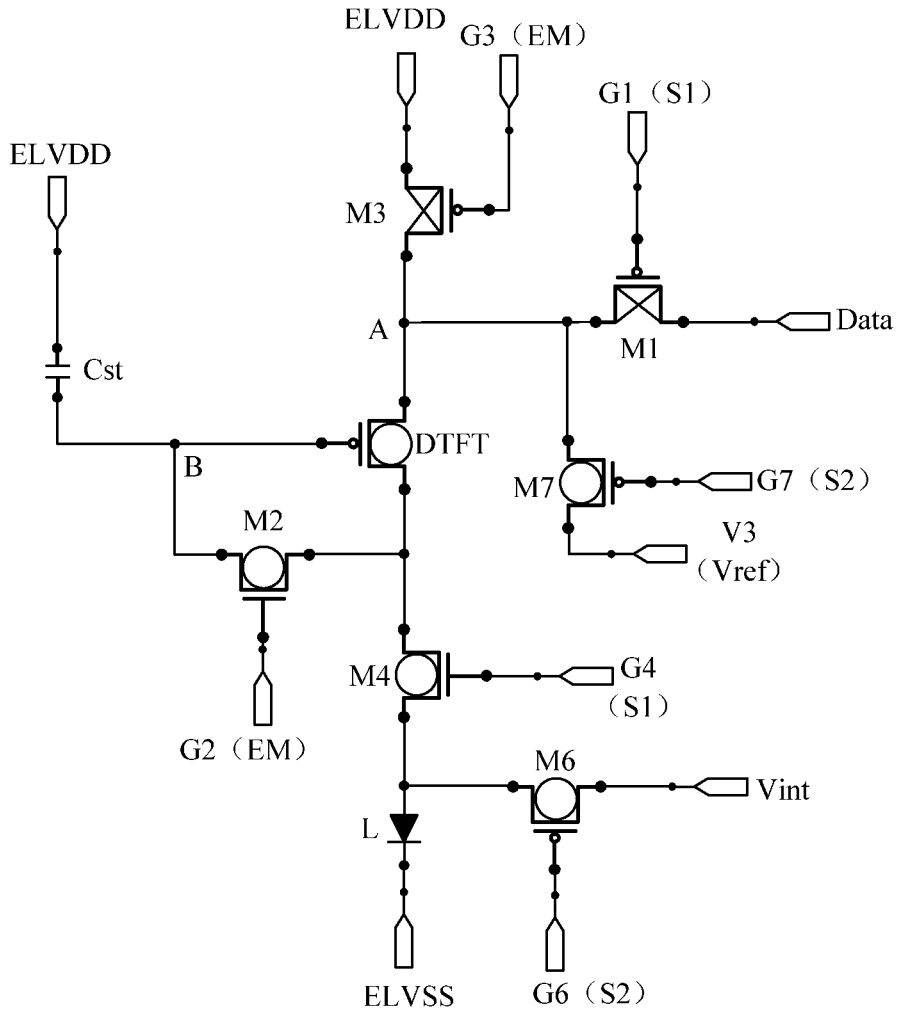
FIGS. 17*a*, 17*b* and 17*c* are respectively working diagrams of the pixel circuit as illustrated in FIG. 16 in the reset period, the write compensation period and the light emission period.

In this case, as illustrated in FIG. 17*a*, under the control of the luminescent control signal terminal EM, the second transistor M2 is switched on; under the control of the first scanning signal terminal S1, the fourth transistor M4 is switched on; and under the control of the second scanning signal terminal S2, the sixth transistor M6 and the seventh transistor M7 are switched on.

At this point, the initial voltage of the initial voltage terminal Vint is transmitted to the drain electrode of the DTFT through the sixth transistor M6 and the fourth transistor M4 and transmitted to the gate electrode of the DTFT through the second transistor M2. At this point, the gate voltage and the drain voltage of the DTFT are $Vg=Vd=V_B=Vint$, and the anode of the light-emitting element L is reset.

In addition, the voltage of the reference voltage terminal Vref is outputted to the source electrode of the DTFT through the ON-Bias seventh transistor M7, and then the source voltage of the DTFT is $Vs=V_A=Vref$.

On the basis of the above, the gate-source voltage of the DTFT is $Vgs=Vg-Vs=Vint-Vref<Vth$, so that the DTFT can be in the on-bias state. In addition, the remaining transistors are all in the off-state.

In the write compensation period P2 of one image frame, as illustrated in FIG. 10*a*, S2=1, S1=0, EM=1, Data=Vdata.

Figure 17B:
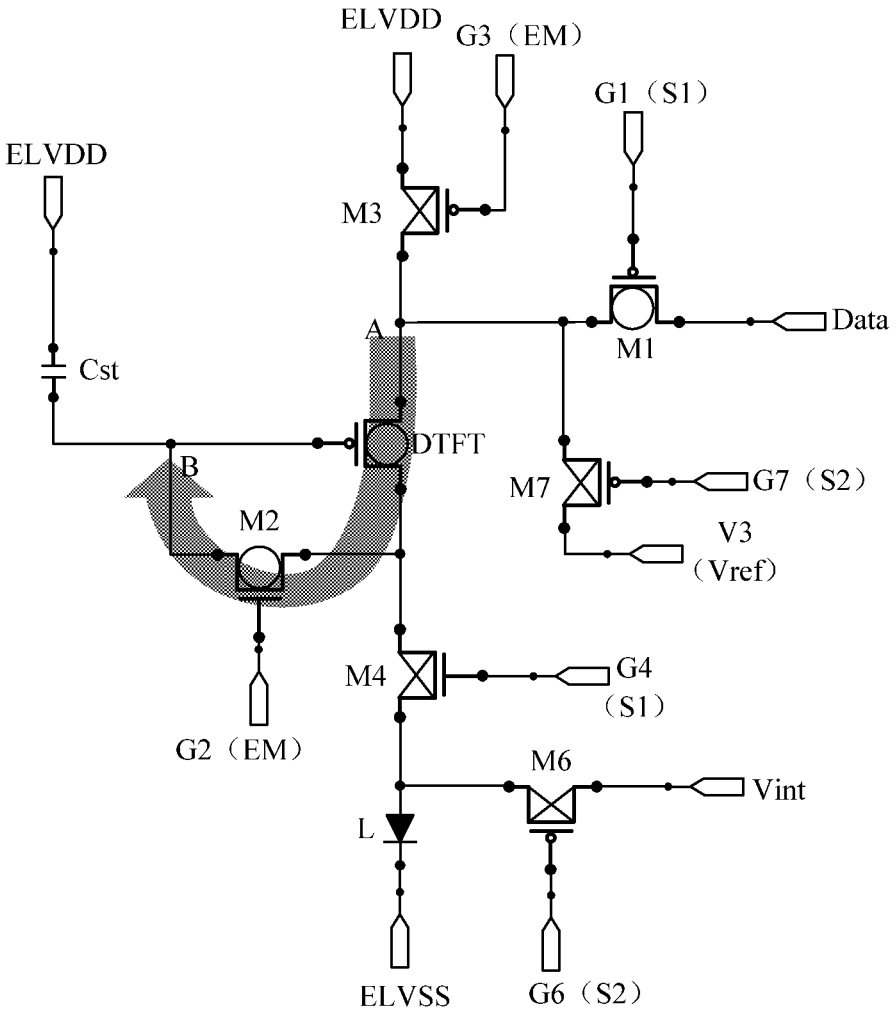

In this case, as illustrated in FIG. 17*b*, under the control of the luminescent control signal terminal EM, the second transistor M2 maintains the on-state. Under the control of the first scanning signal terminal S1, the first transistor M1 is switched on, and the data voltage Vdata outputted by the data voltage terminal Data is transmitted to the source electrode of the DTFT through the first transistor M1. At this point, the source voltage of the DTFT is $Vs=V_A=Vdata$, so as to realize the write of the data voltage.

Due to the switched-on second transistor M2, the gate voltage Vg and the drain voltage Vd of the DTFT are the same, namely Vg=Vd. In this case, the data voltage Vdata of the data voltage terminal Data charges the gate electrode (namely the point B) of the DTFT through the first transistor M1, the DTFT and the second transistor M2, until the voltage of the point B reaches Vdata+Vth. In this way, the threshold voltage Vth of the DTFT is locked to the gate electrode of the DTFT, so that the threshold voltage Vth of the DTFT can be compensated.

In the light emission period P3 of one image frame, as illustrated in FIG. 11*a*, S2=1, S1=1, EM=0, and Data=0.

Figure 17C:
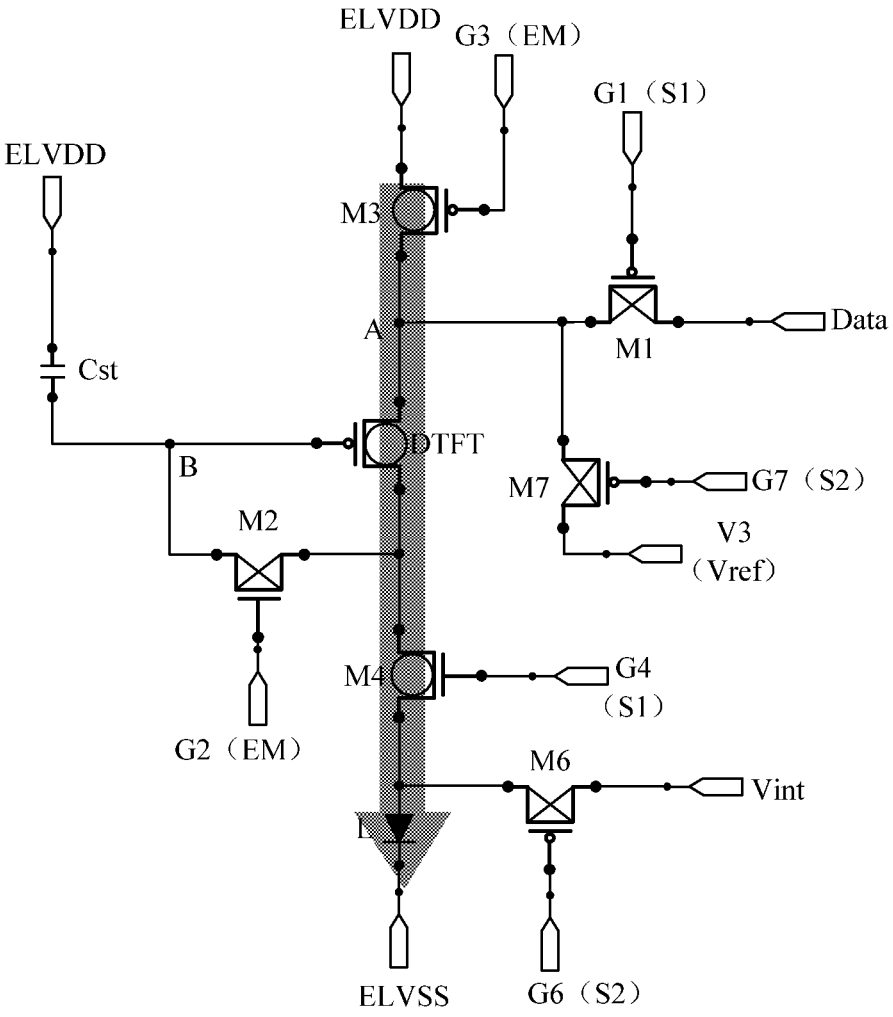

In this case, as illustrated in FIG. 17*c*, under the control of the luminescent control signal terminal EM, the third transistor M3 is switched on; and under the control of the first scanning signal terminal S1, the fourth transistor M4 is switched on. At this point, the voltage of the point A is $V_A=ELVDD$. The voltage of the point B maintains $V_B=Vdata+Vth$. At this moment, the gate-source voltage of the DTFT is $Vgs=Vg-Vs=V_B-V_A=(Vdata+Vth)-ELVDD=Vdata+Vth-ELVDD<Vth$, and Vth is a negative value. Thus, the DTFT is switched on. In addition, the remaining transistors are in the off-state.

On the basis of the above, the drive current $I_{OLED}$ flowing across the light-emitting element L is the same as the above formula (1). Therefore, the drive current $I_{OLED}$ for driving the light-emitting element L to emit light is irrelevant to the threshold voltage Vth of the DTFT.

It should be noted that description is given above by taking the case in which the second transistor M2 and the fourth transistor M4 are N-type transistors and the remaining transistors are P-type transistors as an example. When the second transistor M2 and the fourth transistor M4 are P-type transistors and the remaining transistors are N-type transistors, the control process can be similarly obtained, but part of control signals must be reversed.

The embodiment of the present disclosure provides a display device, which comprises any of above-described pixel circuits.

It should be noted that the display device provided by the embodiment of the present disclosure may be a display device comprising a current drive light-emitting element, including an LED display or an OLED display. The display device may be a TV, a mobile phone, a tablet PC, etc.

On the basis of the above, the display device comprises a display panel. The display panel is provided with sub-pixels arranged in a matrix. The pixel circuit is disposed in the sub-pixel.

In this case, when the gate electrodes of partial transistors in the pixel circuit are connected with the first scanning signal terminal S1 or the second scanning signal terminal S2, except the first row of sub-pixels, the second scanning signal terminals S2 of the pixel circuits in the next row of sub-pixels are connected with the first scanning signal terminals S1 of the pixel circuits in the previous row of sub-pixels. In this way, partial signal terminals of two adjacent rows of sub-pixels are shared, so as to achieve the objective of reducing the number of the signal terminals. Thus, the wiring structure can be simpler.

The embodiments of the present disclosure provide a method for driving any foregoing pixel circuit. Within one image frame, the method comprises the following operations:

Firstly, in the reset period P1, the reset module 10 as illustrated in FIG. 2 is configured to write the initial voltage of the initial voltage terminal Vint into the gate electrode of the DTFT in the drive module 20 and write the voltage of the third voltage terminal V3 into the first electrode or the second electrode of the DTFT. The DTFT is in the on-bias state in the reset period P1.

Secondly, in the write compensation period P2, the write module 30 writes the data voltage Vdata of the data voltage terminal Data into the drive module 20.

The compensation module 40 operates to compensate the threshold voltage of the DTFT in the drive module 20.

Finally, in the light emission period P3, the drive module 20 generates the drive current $I_{OLED}$ under action of the first voltage terminal ELVDD and the second voltage terminal ELVSS and the data voltage Vdata written into the drive module 20. The luminescent control module 50 transmits the drive current $I_{OLED}$ to the light-emitting element L under the control of the luminescent control signal terminal EM. The light-emitting element L is configured to emit light according to the drive current $I_{OLED}$.

It should be noted that when the modules in the pixel circuit have different structures, the specific driving method is as described in the first, second, third, fourth and fifth embodiments, so no further description will be given here. In addition, the method for driving the pixel circuit has the same technical effects with the foregoing embodiments. No further description will be given here.

The foregoing is only the preferred embodiments of the present disclosure and not intended to limit the scope of protection of the present disclosure. Any change or replacement that may be easily thought of by those skilled in the art within the technical scope disclosed by the present disclosure shall fall within the scope of protection of the present disclosure. Therefore, the scope of protection of the present disclosure shall be defined by the appended claims.

The present application claims priority to Chinese patent application No. 201710749538.6, filed on Aug. 25, 2017, the entire disclosure of which is incorporated herein by reference as part of the present application.

What is claimed is:

1. A pixel circuit, comprising: a reset sub-circuit, a drive sub-circuit, a write sub-circuit, a compensation sub-circuit, a light-emitting control sub-circuit and a light-emitting element, wherein the drive sub-circuit comprises a drive transistor; a first electrode of the drive transistor is connected with the write sub-circuit;

the reset sub-circuit is configured to be connected with an initial voltage terminal, a third voltage terminal and the drive sub-circuit and is configured to write an initial voltage of the initial voltage terminal into a gate electrode of the drive transistor in the drive sub-circuit and write a voltage of the third voltage terminal into a first electrode or a second electrode of the drive transistor; the drive transistor is in the on-bias state in the reset period;

the write sub-circuit is configured to be connected with a data voltage terminal and the drive sub-circuit and is configured to write a data voltage of the data voltage terminal into the drive sub-circuit;

the compensation sub-circuit is connected with the drive sub-circuit and is configured to compensate a threshold voltage of the drive transistor in the drive sub-circuit;

the light-emitting control sub-circuit is configured to be connected with a luminescent control signal terminal, a first voltage terminal, the drive sub-circuit and an anode of the light-emitting element; a cathode of the light-emitting element is connected with a second voltage terminal; the light-emitting control sub-circuit is configured to transmit a drive current, generated by the drive sub-circuit under action of the first voltage terminal, the second voltage terminal and the data voltage written into the drive sub-circuit, to the light-emitting element; and the light-emitting element is configured to emit light according to the drive current, wherein the reset sub-circuit comprises a gate electrode reset sub-sub-circuit and a first electrode reset sub-sub-circuit;

the gate electrode reset sub-sub-circuit is configured to be connected with the initial voltage terminal and the gate electrode of the drive transistor and is configured to write the initial voltage of the initial voltage terminal into the gate electrode of the drive transistor;

the first electrode reset sub-sub-circuit is configured to be connected with the third voltage terminal and the first electrode of the drive transistor and is configured to write the voltage of the third voltage terminal into the first electrode of the drive transistor; or the reset sub-circuit comprises a gate electrode reset sub-sub-circuit and a second electrode reset sub-sub-circuit; the gate electrode reset sub-sub-circuit is configured to be connected with the third voltage terminal and the second electrode of the drive transistor; and the second electrode reset sub-sub-circuit is configured to write the voltage of the third voltage terminal into the second electrode of the drive transistor, wherein the gate electrode reset sub-sub-circuit comprises a fifth transistor; a gate electrode of the fifth transistor is configured to be connected with a fifth gate signal terminal; a first electrode of the fifth transistor is connected with the gate electrode of the drive transistor; and a second electrode of the fifth transistor is configured to be connected with the initial voltage terminal, wherein in a case where the reset sub-circuit is further connected with the anode of the light-emitting element, the gate electrode reset sub-sub-circuit comprises a sixth transistor; a gate electrode of the sixth transistor is configured to be connected with a sixth gate signal terminal; a first electrode of the sixth transistor is connected with the anode of the light-emitting element, wherein the third voltage terminal is configured to be connected with a reference voltage terminal;

in a case where the reset sub-circuit comprises the first electrode reset sub-sub-circuit, the first electrode reset sub-sub-circuit comprises a seventh transistor; a gate electrode of the seventh transistor is configured to be connected with a seventh control signal terminal; a first electrode of the seventh transistor is configured to be connected with the reference voltage terminal; and a second electrode of the seventh transistor is connected with the first electrode of the drive transistor;

the fifth gate signal terminal and the sixth gate signal terminal receive different signals, the compensation sub-circuit comprises a second transistor; a gate electrode of the second transistor is configured to be connected with a second gate signal terminal; a first electrode of the second transistor is connected with the gate electrode of the drive transistor; a second electrode of the second transistor is connected with the second electrode of the drive transistor; and the second transistor is an N-type transistor.

2. The pixel circuit according to claim 1, wherein the reset sub-circuit is further connected with the anode of the light-emitting element and is configured to write the initial voltage of the initial voltage terminal into the anode of the light-emitting element.

3. The pixel circuit according to claim 1, wherein the write sub-circuit comprises a first transistor; a gate electrode of the first transistor is configured to be connected with a first gate signal terminal; a first electrode of the first transistor is configured to be connected with the data voltage terminal; a second electrode of the first transistor is connected with the first electrode of the drive transistor;

the light-emitting control sub-circuit comprises a third transistor and a fourth transistor;

a gate electrode of the third transistor is configured to be connected with a third gate signal terminal; a first electrode of the third transistor is configured to be connected with the first voltage terminal; a second electrode of the third transistor is connected with the first electrode of the drive transistor;

a gate electrode of the fourth transistor is configured to be connected with a fourth gate signal terminal; a first electrode of the fourth transistor is connected with the second electrode of the drive transistor; a second electrode of the fourth transistor is connected with the anode of the light-emitting element;

the drive sub-circuit further comprises a storage capacitor; and one end of the storage capacitor is configured to be connected with the first voltage terminal, and another end of the storage capacitor is connected with the gate electrode of the drive transistor.

4. The pixel circuit according to claim 1, wherein the third voltage terminal is configured to be connected with the data voltage terminal;

in a case where the reset sub-circuit comprises the first electrode reset sub-sub-circuit, the write sub-circuit is reused as the first electrode reset sub-sub-circuit; and the first electrode reset sub-sub-circuit comprises the first transistor.

5. The pixel circuit according to claim 1, wherein the third voltage terminal is configured to be connected with the first voltage terminal;

in a case where the reset sub-circuit comprises the first electrode reset sub-sub-circuit, a part of the light-emitting control sub-circuit is reused as the first electrode reset sub-sub-circuit; and the first electrode reset sub-sub-circuit comprises the third transistor.

6. The pixel circuit according to claim 1, wherein in a case where the reset sub-circuit is further connected with the anode of the light-emitting element, the reset sub-circuit further comprises a sixth transistor; a gate electrode of the sixth transistor is configured to be connected with a sixth gate signal terminal; a first electrode of the sixth transistor is connected with the anode of the light-emitting element; and a second electrode of the sixth transistor is configured to be connected with the initial voltage terminal.

7. A display device, comprising the pixel circuit according to claim 1.

8. A method for driving the pixel circuit according to claim 1, wherein within one image frame, the method comprises:

in the reset period, writing, by the reset sub-circuit, the initial voltage of the initial voltage terminal into the gate electrode of the drive transistor in the drive sub-circuit and writing the voltage of the third voltage terminal into the first electrode or the second electrode of the drive transistor; wherein the drive transistor is in the on-bias state in the reset period;

in the write compensation period, writing, by the write sub-circuit, the data voltage of the data voltage terminal into the drive sub-circuit;

compensating, by the compensation sub-circuit, the threshold voltage of the drive transistor in the drive sub-circuit;

in the light emission period, generating, by the drive sub-circuit, the drive current under action of the first voltage terminal, the second voltage terminal and the data voltage written into the drive sub-circuit;

transmitting, by the light-emitting control sub-circuit, the drive current to the light-emitting element under the control of the luminescent control signal terminal; and emitting, by the light-emitting element, light according to the drive current.

9. The method for driving the pixel circuit according to claim 8, wherein in a case where the write sub-circuit comprises a first transistor, the compensation sub-circuit comprises a second transistor, the light-emitting control sub-circuit comprises a third transistor and a fourth transistor, the reset sub-circuit comprises a gate electrode reset sub-sub-circuit and a first electrode reset sub-sub-circuit, the gate electrode reset sub-sub-circuit comprises a fifth transistor, and the first electrode reset sub-sub-circuit comprises the first transistor, the method comprises:

receiving, by a first gate signal terminal connected with a gate electrode of the first transistor, a third gate signal terminal connected with a gate electrode of the third transistor, and a fourth gate signal terminal connected with a gate electrode of the fourth transistor, signals outputted by the luminescent control signal terminal;

receiving, by a second gate signal terminal connected with a gate electrode of the second transistor, signals outputted by a first scanning signal terminal; and receiving, by a fifth gate signal terminal connected with a gate electrode of the fifth transistor, signals outputted by a second scanning signal terminal.

10. The method for driving the pixel circuit according to claim 8, wherein in a case where the write sub-circuit comprises a first transistor, the compensation sub-circuit comprises a second transistor, the light-emitting control sub-circuit comprises a third transistor and a fourth transistor, the reset sub-circuit comprises a gate electrode reset sub-sub-circuit and a first electrode reset sub-sub-circuit, the gate electrode reset sub-sub-circuit comprises a fifth transistor, and the first electrode reset sub-sub-circuit comprises the third transistor, the method comprises:

receiving, by a first gate signal terminal connected with a gate electrode of the first transistor, a third gate signal terminal connected with a gate electrode of the third transistor, and a second gate signal terminal connected with a gate electrode of the second transistor, signals outputted by a first scanning signal terminal;

receiving, by a fourth gate signal terminal connected with a gate electrode of the fourth transistor, signals outputted by the luminescent control signal terminal; and receiving, by a fifth gate signal terminal connected with a gate electrode of the fifth transistor, signals outputted by a second scanning signal terminal.

11. The method for driving the pixel circuit according to claim 8, wherein in a case where the write sub-circuit comprises a first transistor, the compensation sub-circuit comprises a second transistor, the light-emitting control sub-circuit comprises a third transistor and a fourth transistor, the reset sub-circuit comprises a gate electrode reset sub-sub-circuit and a second electrode reset sub-sub-circuit, the gate electrode reset sub-sub-circuit comprises a fifth transistor, and the second electrode reset sub-sub-circuit comprises a seventh transistor, the method comprises:

receiving, by both a first gate signal terminal connected with a gate electrode of the first transistor and a second gate signal terminal connected with a gate electrode of the second transistor, signals outputted by a first scanning signal terminal;

receiving, by both a third gate signal terminal connected with a gate electrode of the third transistor and a fourth gate signal terminal connected with a gate electrode of the fourth transistor, signals outputted by the luminescent control signal terminal; and receiving, by both a fifth gate signal terminal connected with a gate electrode of the fifth transistor and a seventh gate signal terminal connected with a gate electrode of the seventh transistor, signals outputted by a second scanning signal terminal.

12. The method for driving the pixel circuit according to claim 9, wherein the reset sub-circuit comprises a sixth transistor; and the method comprises:

receiving, by a sixth gate signal terminal connected with a gate electrode of the sixth transistor, signals outputted by the first scanning signal terminal.

* * * * *